US010464071B2

(12) United States Patent
Ramesh et al.

(10) Patent No.: US 10,464,071 B2
(45) Date of Patent: Nov. 5, 2019

(54) SYSTEM AND METHOD FOR PREPARING A TREATMENT FLUID

(71) Applicant: Schlumberger Technology Corporation, Sugar Land, TX (US)

(72) Inventors: Avinash Ramesh, Houston, TX (US); Kim Hodgson, Sugar Land, TX (US); Garud Bindiganavale Sridhar, Sugar Land, TX (US); Hau Nguyen-Phuc Pham, Houston, TX (US); William Troy Huey, Fulshear, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 809 days.

(21) Appl. No.: 14/661,709

(22) Filed: Mar. 18, 2015

(65) Prior Publication Data

US 2015/0192006 A1 Jul. 9, 2015

Related U.S. Application Data

(63) Continuation-in-part of application No. 14/030,711, filed on Sep. 18, 2013, now Pat. No. 9,593,565.

(51) Int. Cl.

| | |
|---|---|
| ***B02C 23/20*** | (2006.01) |
| ***E21B 44/00*** | (2006.01) |
| ***E21B 21/06*** | (2006.01) |

(52) U.S. Cl.

CPC ..... *B02C 23/20* (2013.01); *E21B 21/062* (2013.01); *E21B 44/00* (2013.01)

(58) Field of Classification Search

CPC ..... B02C 23/20; C09K 2208/08; C09K 8/00; C09K 8/032; C09K 8/42; C09K 8/92;

(Continued)

(56) References Cited

U.S. PATENT DOCUMENTS 1,916,531 A * 7/1933 Robb ..... B28C 7/064 198/307.1
2,005,800 A * 6/1935 O'Boyle ..... B01F 5/0451 222/280

(Continued)

FOREIGN PATENT DOCUMENTS

RU 2228842 C2 5/2004
WO 2013085410 A1 6/2013

OTHER PUBLICATIONS

International Search Report issued in International Patent Application No. PCT/US2016/019707 dated May 25, 2016; 3 pages.

(Continued)

*Primary Examiner* — Tony G Soohoo

(57) ABSTRACT

A system and method are disclosed for preparing a treatment fluid and includes charging packets containing an additive encased within a liner to a first container packet storage area of a first container; passing the packets to a packet shredder; breaching the liners of the packets to expose the additive; passing exposed additive to a mixer; passing an aqueous solution to the mixer from a second container; and mixing the exposed additive with the aqueous solution to form the treatment fluid. The first container can also include a first container proppant storage area, and proppant is passed from the first container proppant storage area to the mixer. The treatment fluid can be charged to a well bore penetrating a subterranean formation. The system and method can also include a silo positioned in fluid flow communication with the first container and partitioned into a silo packet storage area and a silo proppant storage area.

12 Claims, 21 Drawing Sheets

(58) Field of Classification Search
CPC ..... E21B 21/062; E21B 44/00; E21B 33/13; E21B 43/26; E21B 43/267
See application file for complete search history.

(56) References Cited

U.S. PATENT DOCUMENTS 2,478,079 A * 8/1949 Beasley ..... B01F 15/0235 222/136
2,638,252 A * 5/1953 Zahn ..... B01F 15/0235 222/139
4,023,706 A * 5/1977 Dearlove ..... B28C 5/404 106/644
4,285,601 A * 8/1981 Miner ..... B01F 5/02 137/577
4,390,371 A * 6/1983 Cornwell ..... B28C 5/386 106/644
4,453,829 A 6/1984 Althouse
4,808,004 A 2/1989 McIntire et al.
4,946,339 A 8/1990 Berg et al.
5,030,314 A 7/1991 Lang
5,091,255 A * 2/1992 Hsu ..... B29B 9/14 428/299.4
5,190,374 A 3/1993 Harms et al.
5,224,774 A * 7/1993 Valle ..... B28C 5/402 206/524.7
5,807,458 A * 9/1998 Sanders ..... B28B 1/52 156/276
5,931,610 A * 8/1999 Rixom ..... B01F 7/30 222/58
5,985,449 A 11/1999 Dill
6,283,327 B1 * 9/2001 Rubtsov ..... B65G 53/14 222/168
6,348,093 B1 * 2/2002 Rieder ..... B28C 5/40 106/724
6,550,362 B1 * 4/2003 Galinat ..... B26D 5/32 366/151.1
6,945,686 B2 * 9/2005 Dewinter ..... B01F 15/0205 366/153.3
7,042,272 B2 5/2006 Dornbusch
7,049,272 B2 5/2006 Sinclair et al.
7,490,449 B1 2/2009 Eibert
7,906,597 B2 3/2011 Fouarge
8,109,456 B2 2/2012 Christensen
8,322,424 B2 * 12/2012 Leugemors ..... E21B 21/062 166/276
8,322,600 B2 * 12/2012 Vitt ..... B28B 23/0031 235/375
8,545,091 B1 10/2013 Arribau
9,016,377 B2 * 4/2015 Leugemors ..... E21B 21/062 166/276
2004/0109384 A1 6/2004 Dewinter
2007/0014185 A1 1/2007 Diosse et al.
2007/0081866 A1 * 4/2007 Deal ..... E21B 21/062 406/122
2008/0135245 A1 6/2008 Smith et al.
2008/0179054 A1 * 7/2008 McGough ..... E21B 43/26 166/250.14
2008/0179092 A1 7/2008 Fragachan et al.
2008/0245527 A1 * 10/2008 Leugemors ..... E21B 21/062 166/280.1
2009/0148632 A1 6/2009 Danielsson et al.
2010/0038077 A1 2/2010 Heilman et al.
2010/0188926 A1 7/2010 Stegemoeller et al.
2010/0243252 A1 9/2010 Luharuka et al.
2011/0024129 A1 2/2011 Turakhia et al.
2011/0061855 A1 3/2011 Case et al.
2011/0155373 A1 6/2011 Goddard et al.
2012/0199356 A1 8/2012 Nichols
2012/0227967 A1 9/2012 Shaikh et al.
2012/0231982 A1 9/2012 Weinstein et al.
2012/0285695 A1 11/2012 Lafferty et al.
2013/0092377 A1 * 4/2013 Leugemors ..... E21B 21/062 166/292
2013/0105166 A1 5/2013 Medvedev et al.
2014/0000891 A1 1/2014 Mahoney et al.
2014/0034310 A1 2/2014 Andersen
2014/0041317 A1 2/2014 Pham et al.
2014/0041319 A1 2/2014 Pham et al.
2014/0041322 A1 2/2014 Pham et al.
2014/0102301 A1 * 4/2014 Marks ..... E21B 43/26 95/280
2014/0102695 A1 4/2014 Adil et al.
2015/0075796 A1 3/2015 Lecerf et al.
2015/0103869 A1 4/2015 Moscato et al.
2015/0135817 A1 5/2015 Moscato et al.
2015/0167447 A1 6/2015 Tjhang et al.
2015/0192006 A1 * 7/2015 Ramesh ..... B02C 23/20 166/305.1
2015/0198015 A1 7/2015 Barreto et al.
2015/0361775 A1 * 12/2015 Pham ..... E21B 43/12 166/305.1

OTHER PUBLICATIONS

Written Opinion issued in International Patent Application No. PCTMS2016/019707 dated May 25, 2016; 6 pages.
Decision on Grant issued in Russian Patent Appl. No. 2017134370 dated Aug. 14, 2018; 15 pages (with English translation).
International Search Report and Written Opinion issued PCT/US2014/055725 dated Dec. 30, 2014; 11 pages.

* cited by examiner

SYSTEM AND METHOD FOR PREPARING A TREATMENT FLUID

CROSS REFERENCE TO RELATED APPLICATION

This application is a continuation-in-part application of application Ser. No. 14/030,711, entitled "WELLSITE HANDLING SYSTEM FOR PACKAGED WELLSITE MATERIALS AND METHOD OF USING SAME" filed on Sep. 18, 2013 and which is hereby incorporated by reference in its entirety.

FIELD

The disclosure generally relates to the preparation of subterranean formation treatment fluids, and more particularly, but not by way of limitation, systems and methods for introducing additives into a treatment fluid using additive packets.

BACKGROUND

The statements in this section merely provide background information related to the disclosure and may not constitute prior art.

In the oil and gas drilling and production industry, viscous aqueous fluids are commonly used in treating subterranean wells, as well as carrier fluids. Such fluids may be used as fracturing fluids, acidizing fluids, and high-density completion fluids. In an operation known as well fracturing, such fluids are used to initiate and propagate underground fractures for increasing petroleum productivity.

Viscous fluids, such as gels, are typically an aqueous solution of a polymer material. Such fluids can also contain other additives such as fibers, fluid loss additives (FLAs), and breakers. Currently, the process for feeding such additives (for example fiber) is manually intensive, requiring an operator to open bulk bags of the additive over a feeder (such as a screw feeder) for feeding into a mixer for introduction of the additive into the treatment fluid. The material itself can be challenging to feed owing to its high aspect ratio in the case of fibers, or the small particle diameters in the case of powders like FLAs or breakers. Consequently, such a manual feeding technique results in a lack of consistent control of the rate of additive addition.

Therefore, there is a need for efficient systems and methods useful for feeding additives to a treatment fluid which are less dependent on operator activity, and are less influenced by the physical properties of the particles, such need met, at least in part, by the following disclosure.

SUMMARY

In an embodiment, a system for preparing a treatment fluid is disclosed including a first container containing a first container packet storage area having a packet delivery opening, wherein the first container packet storage area is for storing packets containing an additive encased within a liner; a packet shredder including a shredder inlet and a shredder outlet, wherein the shredder inlet is positioned below the packet delivery opening; a mixer having a first mixer inlet, a second mixer inlet and a mixer outlet, wherein the first mixer inlet is positioned in fluid flow communication with the shredder outlet; and a second container holding an aqueous solution and having an aqueous solution outlet in fluid flow communication with the second mixer inlet.

The system may further include a wellbore penetrating a subterranean formation and connected in fluid flow communication with the mixer outlet by a mixer outlet conduit.

The first container may further include a first container proppant storage area for storing proppant and having a proppant delivery opening.

In accordance with another embodiment, a method for preparing a treatment fluid is disclosed and includes: utilizing packets containing an additive encased within a liner in a first container packet storage area of a first container; passing the packets from the first container packet storage area to a packet shredder positioned below the first container; at least partially breaching the liners of the packets to expose the additive, thereby forming exposed additive; passing the exposed additive to a first mixer inlet of a mixer; passing an aqueous solution to a second mixer inlet of the mixer; and mixing the exposed additive with the aqueous solution in the mixer to form a treatment fluid.

The method may further include charging the treatment fluid to a wellbore penetrating a subterranean formation.

The first container may further include a first container proppant storage area for storing proppant and having a proppant delivery opening and the method may further include passing the proppant to the first mixer inlet to become a part of the treatment fluid.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Finally, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Some aspects of the disclosure relate to systems for, and methods for, preparing a treatment fluid.

Figure 1:
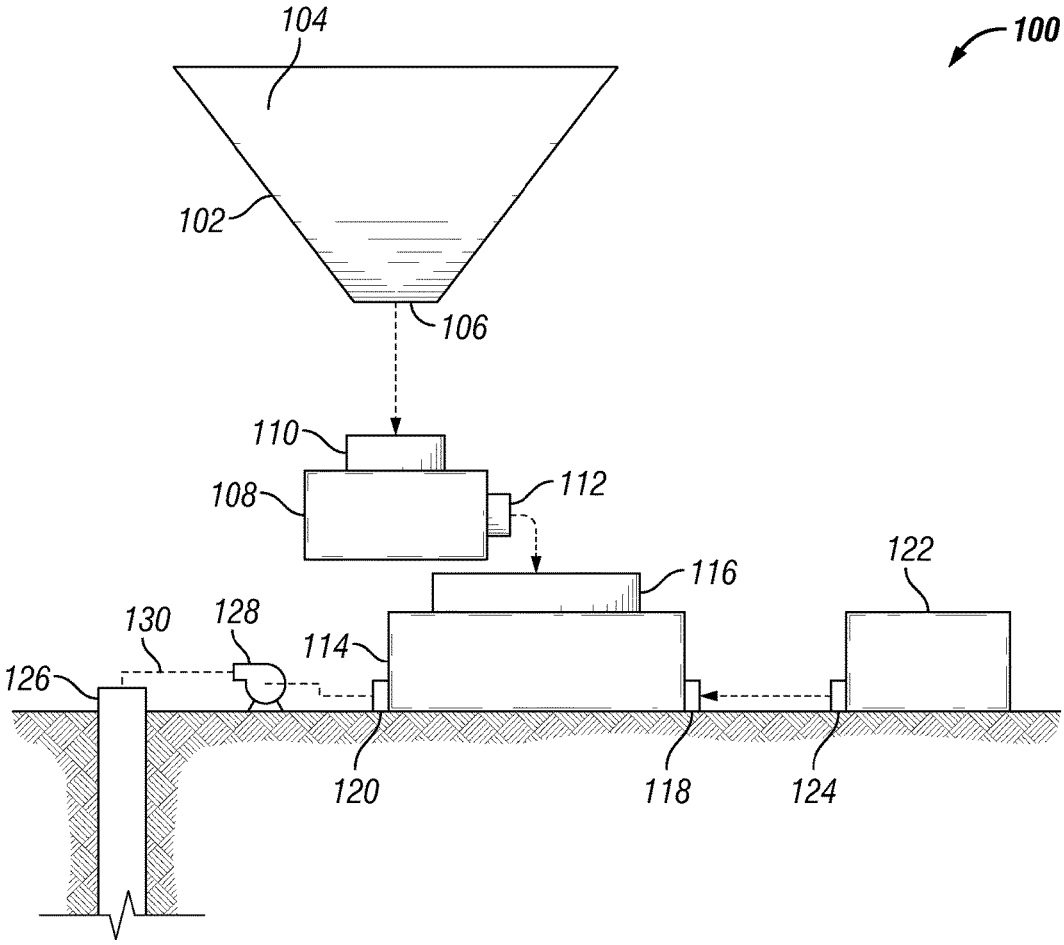
FIG. 1 illustrates some embodiments in accordance with the disclosure.

With reference to FIG. 1, in some embodiments, the system 100 for preparing a treatment fluid can comprise, consist of, or consist essentially of a first container 102 comprising a first container packet storage area 104 having a packet delivery opening 106, wherein the first container packet storage area 104 is for storing a plurality of individual packets 1701 (see FIGS. 17A-17D). Each of the individual packets 1701 comprise an additive 1702 encased within a liner 1703; a packet shredder 108 comprising a shredder inlet 110 and a shredder outlet 112, wherein the shredder inlet 110 is positioned below the packet delivery opening 106; a mixer 114 having a first mixer inlet 116, a second mixer inlet 118 and a mixer outlet 120, wherein the first mixer inlet 116 is positioned in fluid flow communication with the shredder outlet 112; and a second container 122 comprising an aqueous solution and having an aqueous solution outlet 124 in fluid flow communication with the second mixer inlet 118. The first container 102 can be a hopper or can be a silo.

In some embodiments, the system 100 can further comprise a wellbore 126 penetrating a subterranean formation and connected in fluid flow communication with the mixer outlet 120. The wellbore can be connected to the mixer outlet 120 by a pump 128 and a mixer outlet conduit 130.

In some embodiments, with reference to FIGS. 1-4, a chute 132 can be positioned between the packet delivery opening 106 and the packet shredder inlet 110 to convey the packets from the first container packet storage area 104 to the packet shredder 108. In accordance with some embodiments, a metering device 134 can be positioned between the chute 132 and the packet shredder inlet 110 to meter the packets prior to conveying the packets to the packet shredder 108. In accordance with some embodiments, with reference to FIGS. 1 and 3, the metering device 134 can be positioned between the packet delivering opening 106 and the chute 132 to meter the packets prior to conveying the packets to the chute 132. The metering device can be selected from the group consisting of a metering auger, an optical counter device, or a rotary valve that selectively allows a given number of pouches per revolution, or combinations thereof.

In accordance with some embodiments, with reference to FIGS. 1-4, system 100 can further comprise an auger 136 having an auger inlet 138 and an auger outlet 140; and wherein the shredder outlet 112 is connected in fluid flow communication with the auger inlet 138 and the auger outlet 140 is positioned in fluid flow communication with the first mixer inlet 116.

Figure 5:
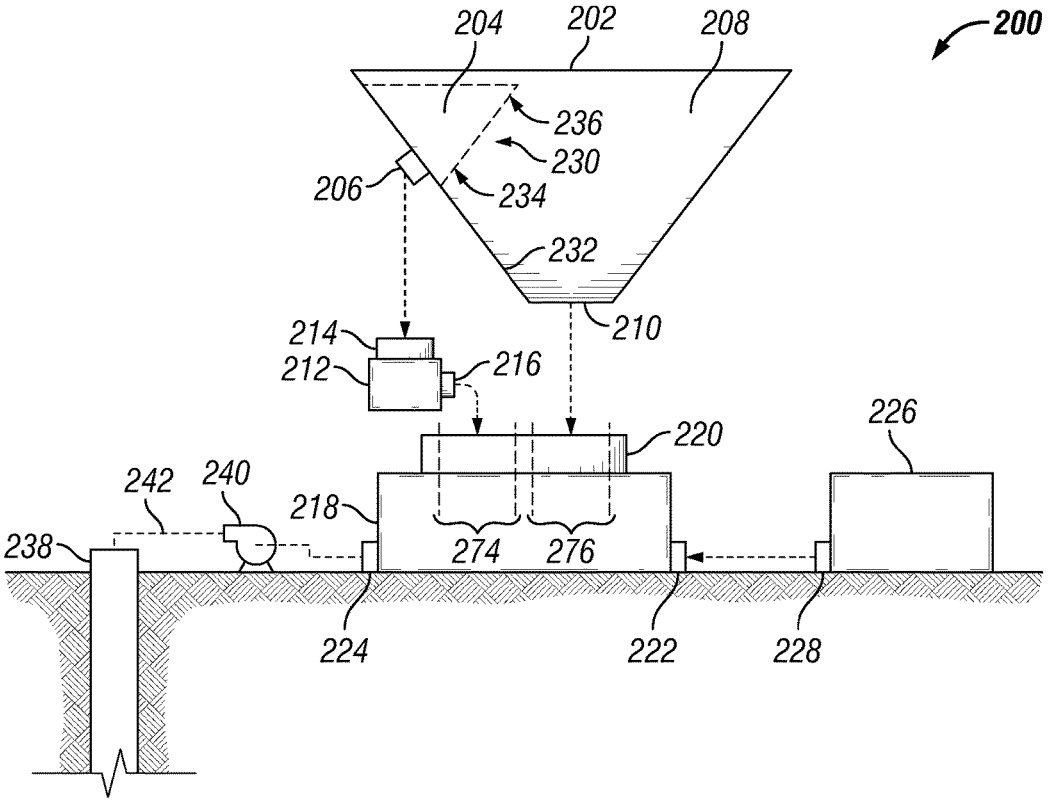
FIG. 5 illustrates some embodiments in accordance with the disclosure.

In some embodiments, as shown in FIG. 5, a system 200 can comprise, consist of, or consist essentially of a first container 202 comprising a first container packet storage area 204 having a packet delivery opening 206, wherein the first container packet storage area 204 is for storing packets comprising an additive encased within a liner, and a first container proppant storage area 208 for storing proppant and having a proppant delivery opening 210; a packet shredder 212 comprising a shredder inlet 214 and a shredder outlet 216, wherein the shredder inlet 214 is positioned below the packet delivery opening 206; a mixer 218 having a first mixer inlet 220, a second mixer inlet 222 and a mixer outlet 224, wherein the first mixer inlet 220 is positioned in fluid flow communication with the shredder outlet 216 and with the proppant delivery opening 210; and a second container 226 comprising an aqueous solution and having an aqueous solution outlet 228 in fluid flow communication with the second mixer inlet 222. Further, the first container packet storage area 204 can be defined by a diverter 230 sealably attached to an inner wall 232 of the first container 202. The diverter 230 can comprise a diverting plate comprising a lower end 234 attached to the inner wall 232 of the first container, and an upper end 236. In accordance with some embodiments, the first container can be a hopper (as shown)

or can be a silo comprising a partition defining the first container packet storage area and the first container proppant storage area.

In some embodiments, the system 200 can further comprise a wellbore 238 penetrating a subterranean formation and connected in fluid flow communication with the mixer outlet 224. The wellbore can be connected to the mixer outlet 224 by a pump 240 and a mixer outlet conduit 242.

In accordance with some embodiments, as shown in FIG. 5, the shredder outlet 216 can be positioned above a first area 274 of first mixer inlet 220; and the proppant delivery opening 210 can be positioned above a second area 276 of first mixer inlet 220.

Figure 5A:
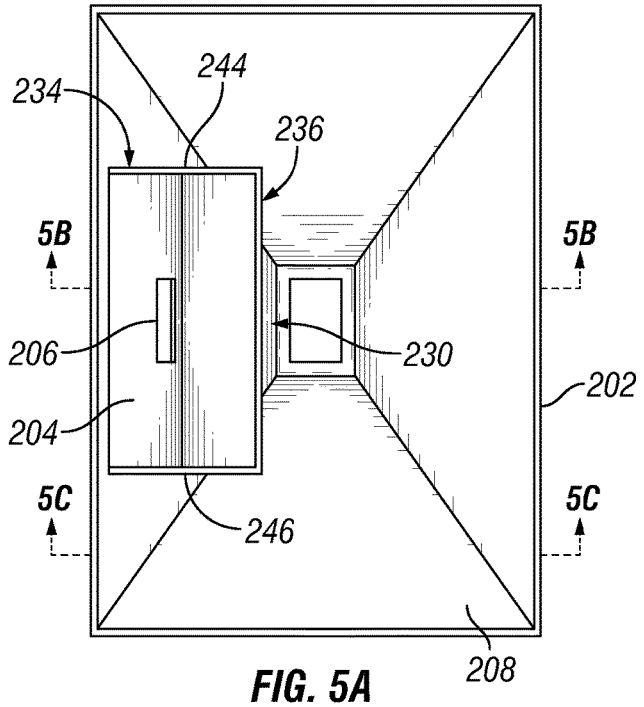
FIG. 5A depicts a top plan view of hopper 202 of FIG. 5 in accordance with some embodiments of the disclosure.
Figure 5B:
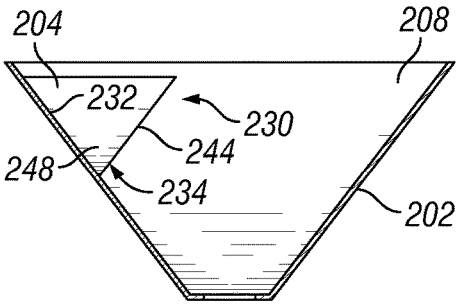
FIG. 5B depicts a side view of hopper 202 along cross section 5B-5B of FIG. 5A in accordance with some embodiments of the disclosure.
Figure 5C:
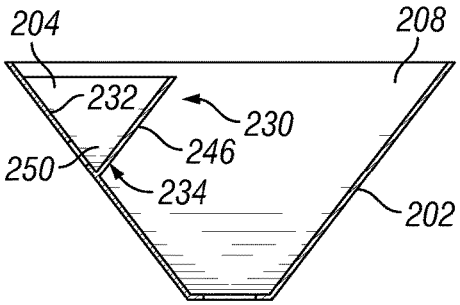
FIG. 5C depicts a side view of hopper 202 along cross section 5C-5C of FIG. 5A in accordance with some embodiments of the disclosure.
Figure 6:
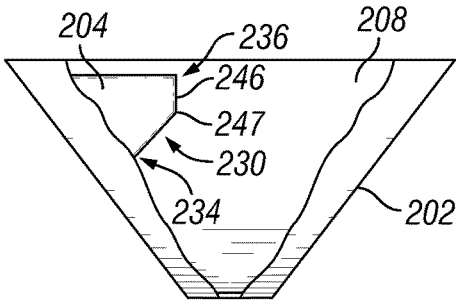
FIG. 6 is a cutaway view illustrating some embodiments of a diverter 230 in a hopper 202 in accordance with some embodiments of the disclosure.

As shown in FIG. 5A, which is a top plan view of first container 202 shown in FIG. 5, the diverter 230 can further comprise a first side edge 244 and a second side edge 246. As shown in FIGS. 5B and 5C, which are side views of first container 202 along cross sections 5B-5B and 5C-5C of FIG. 5A, respectively, the diverter can comprise a first sealing member 248 attached to the first side edge 246 and the inner wall 232, and a second sealing member 250 attached to the second side edge 246 and the inner wall 232. The lower end 234 of the diverting plate can be hinged to the inner wall 232 of the first container 202 and the configurations of the first sealing member 248 and the second sealing member 250 can each be adjustable to allow changes in the position of the diverting plate 230, allowing adjustment of the sizes of the first container packet storage area 204 and the first container proppant storage area 208. In accordance with some embodiments, first and second sealing members 248 and 250 can be fixed or adjustable. If adjustable, first and second sealing members 248 and 250 can be of any configuration and/or material which allows them to be adjustable. First and second sealing members 248 and 250 can be composed of a pliable material, sliding metal plates, and or can be of an accordion design. With reference to FIG. 6, the upper end 236 of the diverting plate 230 can comprise a hinged section 246 connected to the lower end 234 by hinge 247. This hinge would help with limiting the radial path covered by the upper end 236, so as to avoid any obstruction when a silo is placed directly above the first container in the path of the movable diverting plate 230.

Figure 7:
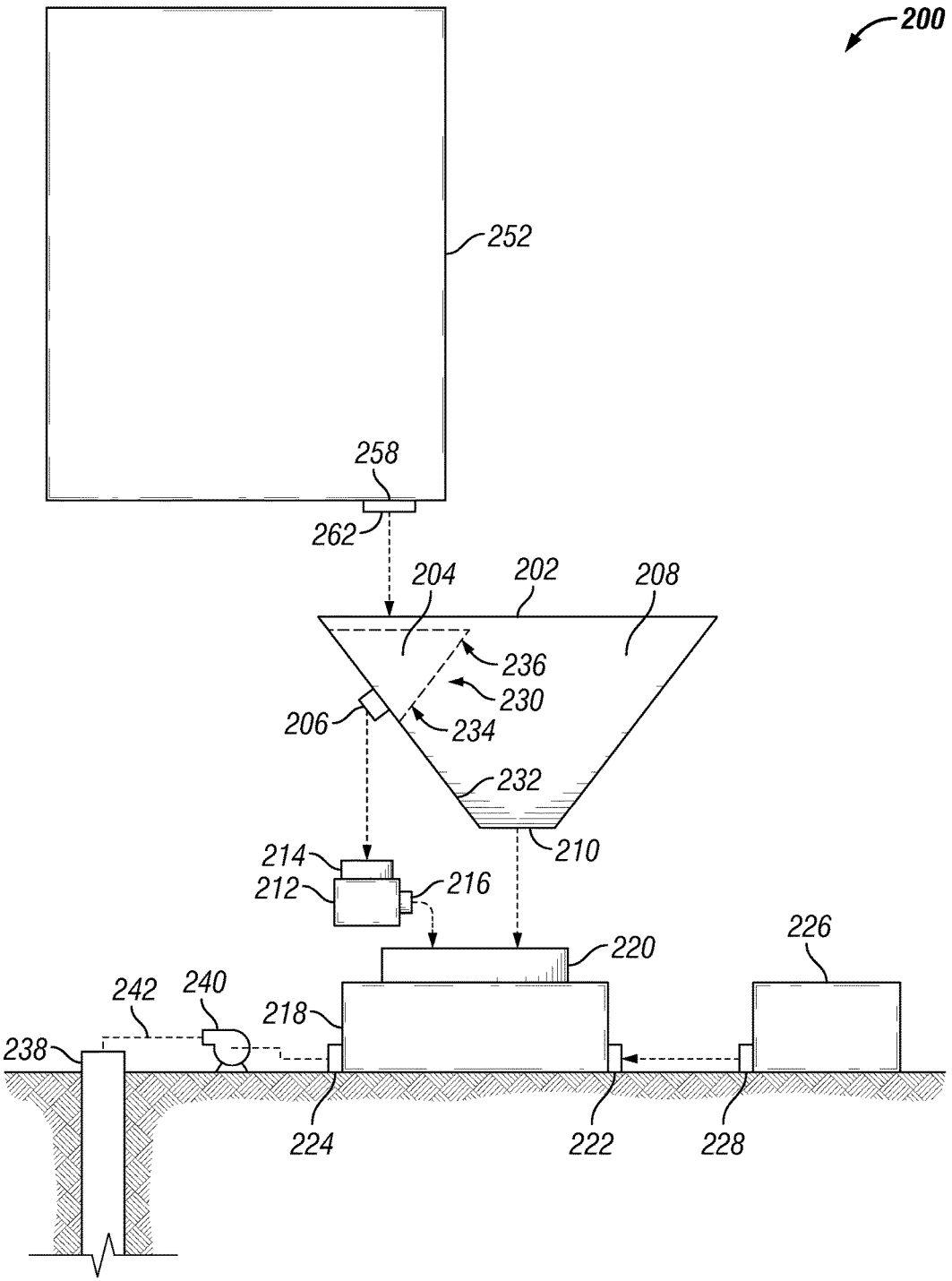
FIG. 7 illustrates some embodiments in accordance with the disclosure.
Figure 8:
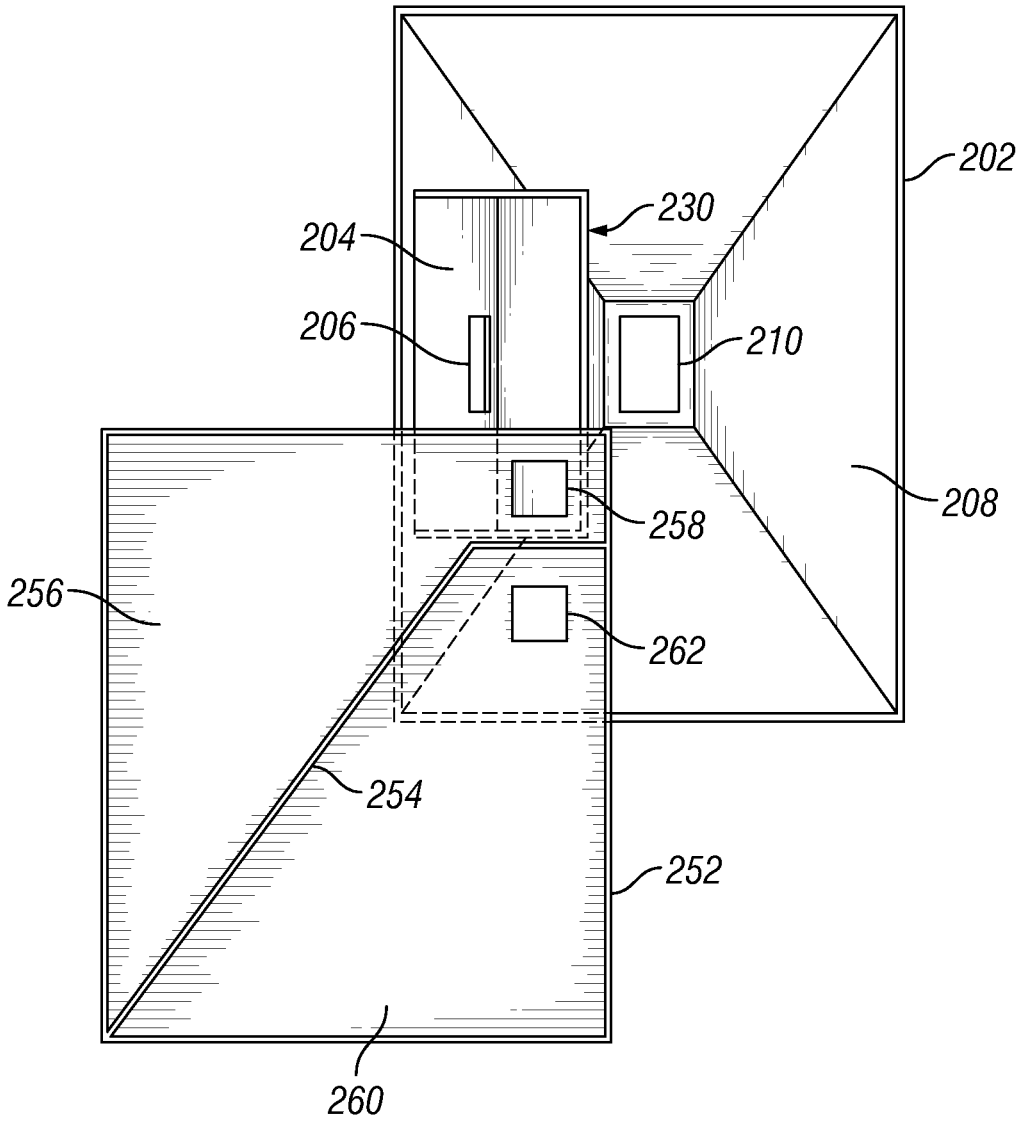
FIG. 8 depicts a top plan view of silo 252 and hopper 202 of FIG. 7 in accordance with some embodiments of the disclosure.

In accordance with some embodiments, as shown in FIG. 7, system 200 can further comprise a silo 252 positioned above the first container 202. FIG. 8 is a top plan view of silo 252 and first container 202. With reference to FIGS. 7 and 8, silo 252 comprises a partition 254 dividing the silo 252 into a silo packet storage area 256 having a silo packet outlet 258 and a silo proppant storage area 260 having a silo proppant outlet 262, wherein the silo packet outlet 258 is positioned above the first container packet storage area 204 and the silo proppant outlet 262 is positioned above the first container proppant storage area 208.

Figure 9:
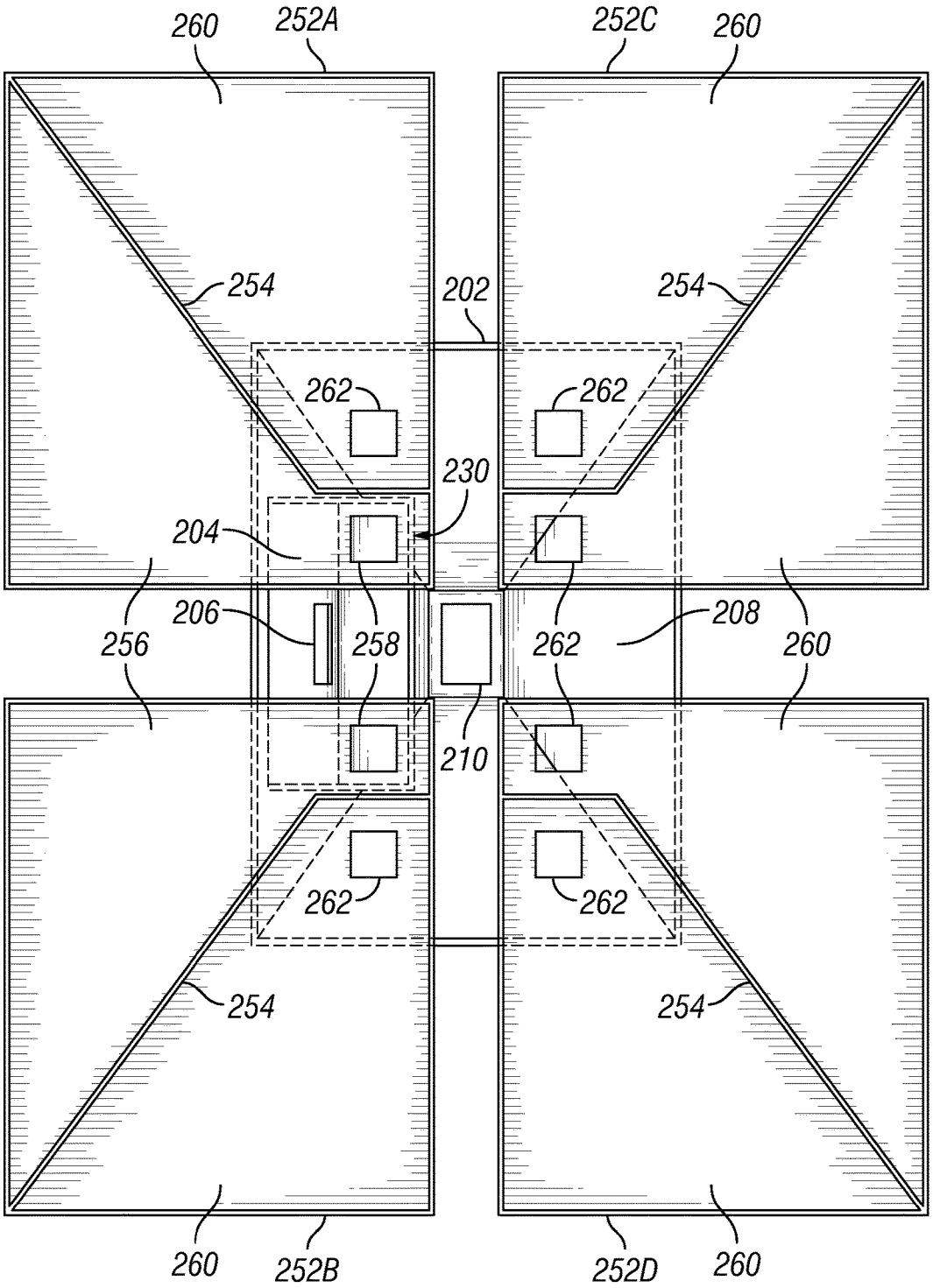
FIG. 9 depicts a top plan view of hopper 202 of FIG. 7 with four silos 252A-252D positioned above hopper 202 in accordance with some embodiments of the disclosure.

In accordance with some embodiments, FIG. 9 is a top plan view showing four silos 252A-252D positioned above first container 202. With reference to FIGS. 7-9, Silos 252A and 252B each comprise a partition 254 dividing the silo into a silo packet storage area 256 having a silo packet outlet 258 and a silo proppant storage area 260 having a silo proppant outlet 262, wherein the silo packet outlet 258 is positioned above the first container packet storage area 204 and the silo proppant outlet 262 is positioned above the first container proppant storage area 208. Silos 252C and 252D each comprise a partition 254 dividing the silo into two silo proppant storage areas 260 each having a silo proppant outlet 262 positioned above the first container proppant storage area 208.

Figure 10:
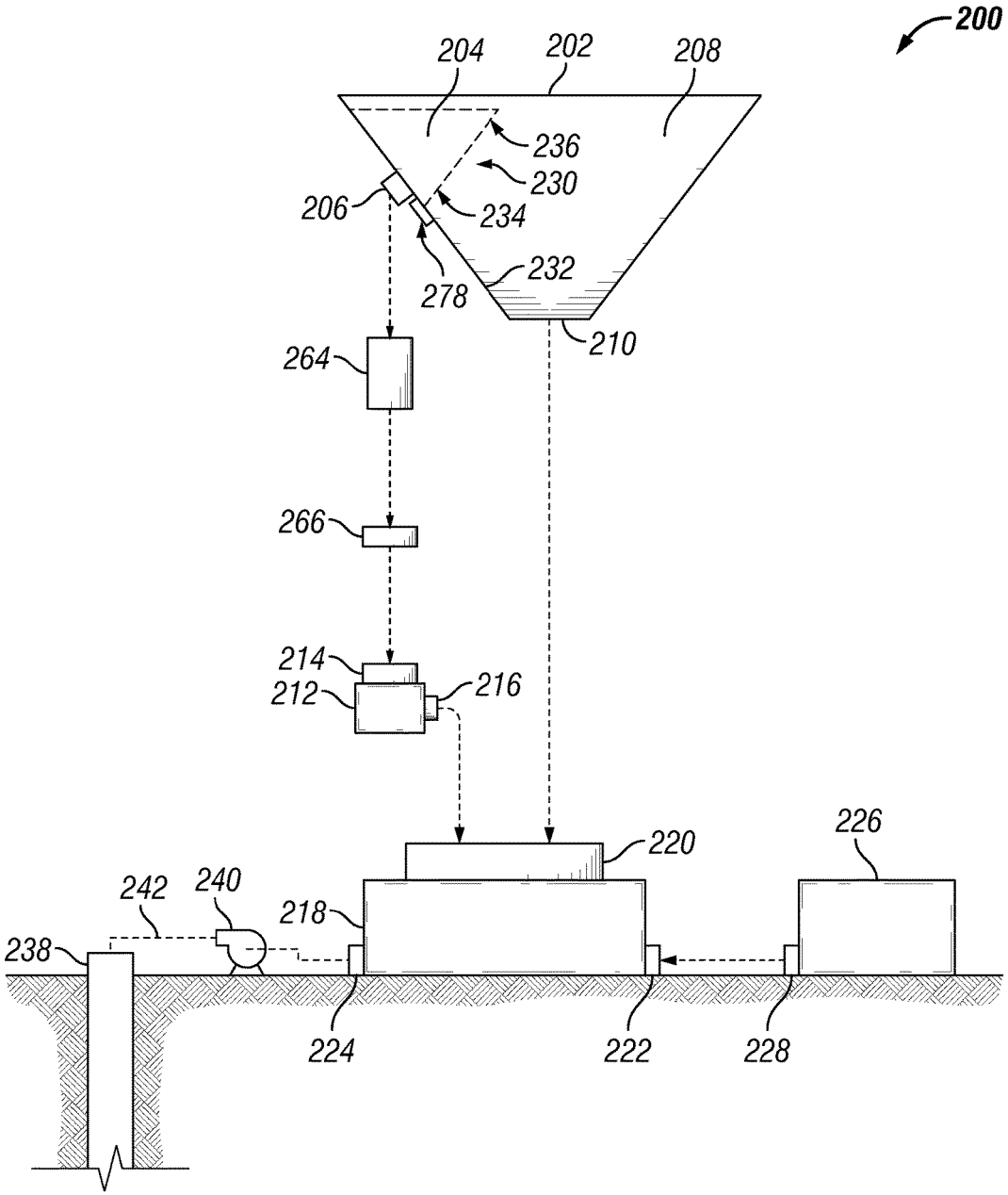
FIG. 10 illustrates some embodiments in accordance with the disclosure.
Figure 11:
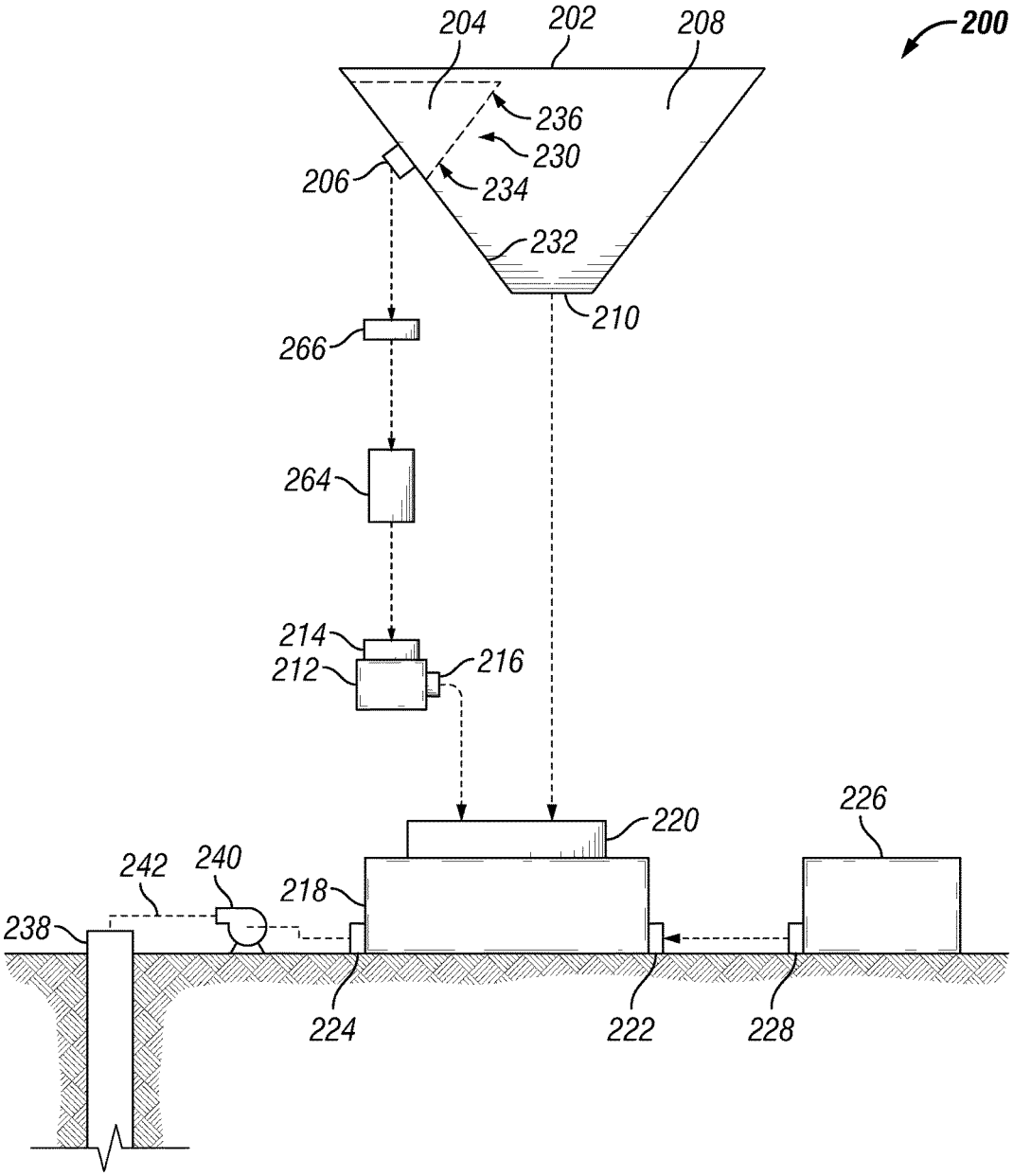
FIG. 11 illustrates some embodiments in accordance with the disclosure.

In accordance with some embodiments, and with reference to FIGS. 5 and 10, a chute 264 can be positioned between the packet delivery opening 206 and the packet shredder inlet 214 to convey the packets from the first container packet storage area 204 to the packet shredder 212. In accordance with some embodiments, as shown in FIG. 10, a metering device 266 can be positioned between the chute 264 and the packet shredder inlet 214 to meter the packets prior to conveying the packets to the packet shredder 212. In accordance with some embodiments, as shown in FIG. 11, the metering device 266 can be positioned between the packet delivery opening 206 and the chute 264 to meter the packets prior to conveying the packets to the chute 264. The metering device can be selected from the group consisting of a metering auger, an optical counter device, or a rotary valve that selectively allows a given number of pouches per revolution, or combinations thereof.

Figure 12:
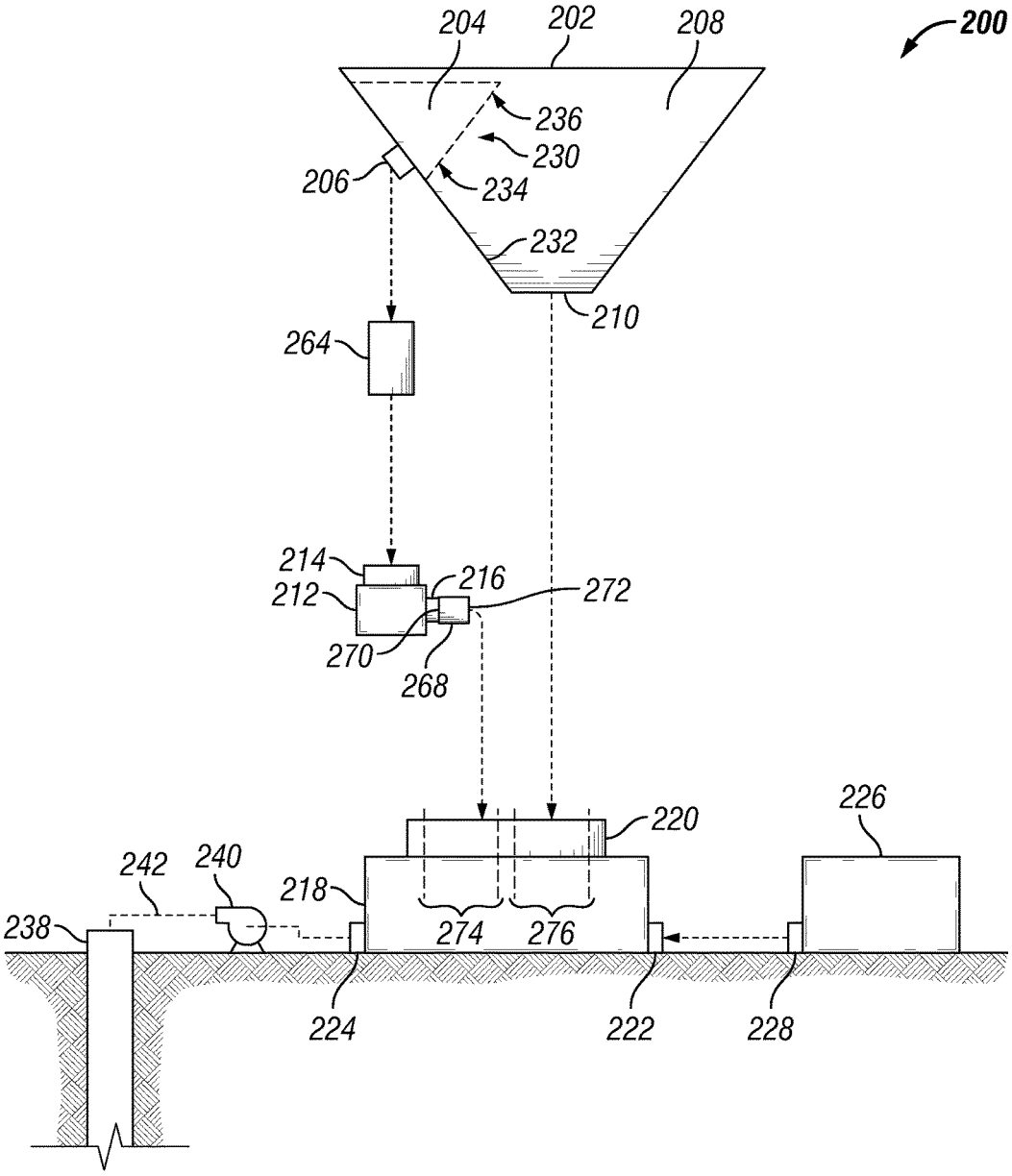
FIG. 12 illustrates some embodiments in accordance with the disclosure.

In accordance with some embodiments, as shown in FIG. 12, system 200 can further comprise an auger 268 having an auger inlet 270 and an auger outlet 272; and wherein the shredder outlet 216 is connected in fluid flow communication with the auger inlet 270 and the auger outlet 272 is positioned in fluid flow communication with the first mixer inlet 220. In accordance with some embodiments, as shown in FIG. 12, the auger outlet 272 can be positioned above a first area 274 of first mixer inlet 220; and wherein the proppant delivery opening 210 can be positioned above a second area 276 of first mixer inlet 220.

Figure 13:
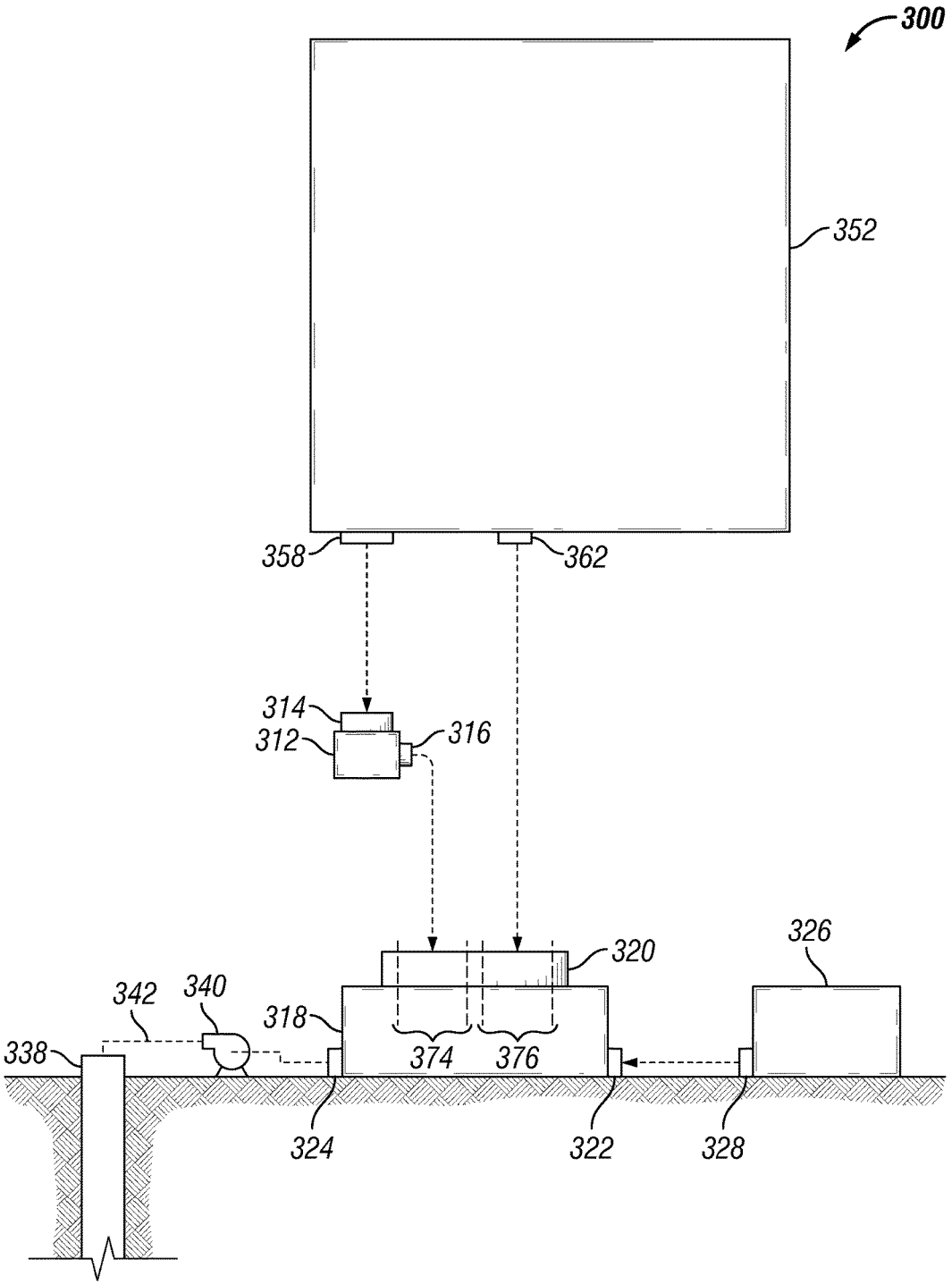
FIG. 13 illustrates some embodiments in accordance with the disclosure.
Figure 13A:
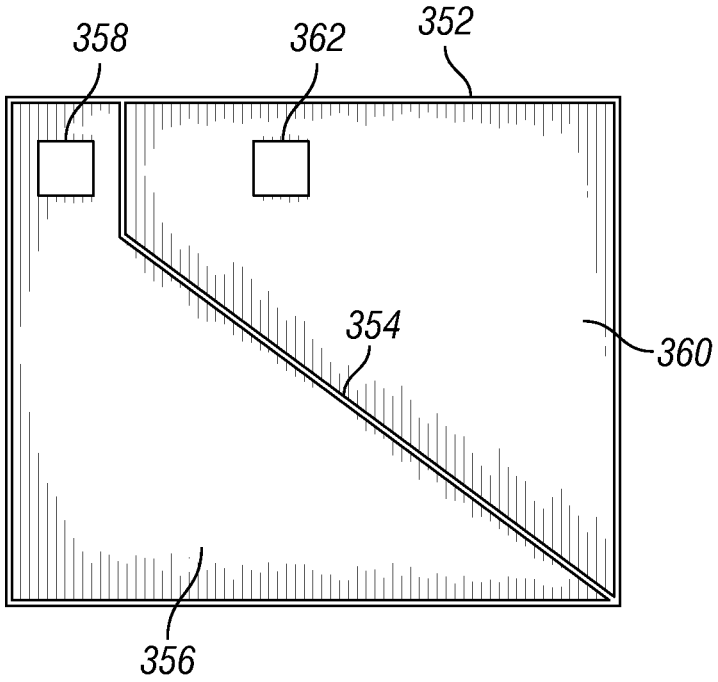
FIG. 13A is a top plan view of silo 352 of FIG. 13 in accordance with some embodiments of the disclosure.

In some embodiments, as shown in FIG. 13, a system 300 can comprise, consist of, or consist essentially of a silo 352 (as the first container) having a silo packet outlet 358 and a silo proppant outlet 362; a packet shredder 312 comprising a shredder inlet 314 and a shredder outlet 316, wherein the shredder inlet 314 is positioned below the silo packet outlet 358; a mixer 318 having a first mixer inlet 320, a second mixer inlet 322 and a mixer outlet 324, wherein the first mixer inlet 320 is positioned in fluid flow communication with the shredder outlet 316 and with the silo proppant outlet 362; and a container 326 comprising an aqueous solution and having an aqueous solution outlet 328 in fluid flow communication with the second mixer inlet 322. FIG. 13A is a top plan view of silo 352. With reference to FIGS. 13 and 13A, silo 352 comprises a partition 354 dividing the silo 352 into a silo packet storage area 356 for storing packets comprising an additive encased within a liner and having silo packet outlet 358, and a silo proppant storage area 360 for storing proppant and having silo proppant outlet 362.

In some embodiments, the system 300 can further comprise a wellbore 338 penetrating a subterranean formation and connected in fluid flow communication with the mixer outlet 324. The wellbore can be connected to the mixer outlet 324 by a pump 340 and a mixer outlet conduit 342.

In accordance with some embodiments, as shown in FIG. 13, the shredder outlet 316 can be positioned above a first area 374 of first mixer inlet 320; and the silo proppant outlet 362 can be positioned above a second area 376 of first mixer inlet 320.

Figure 14:
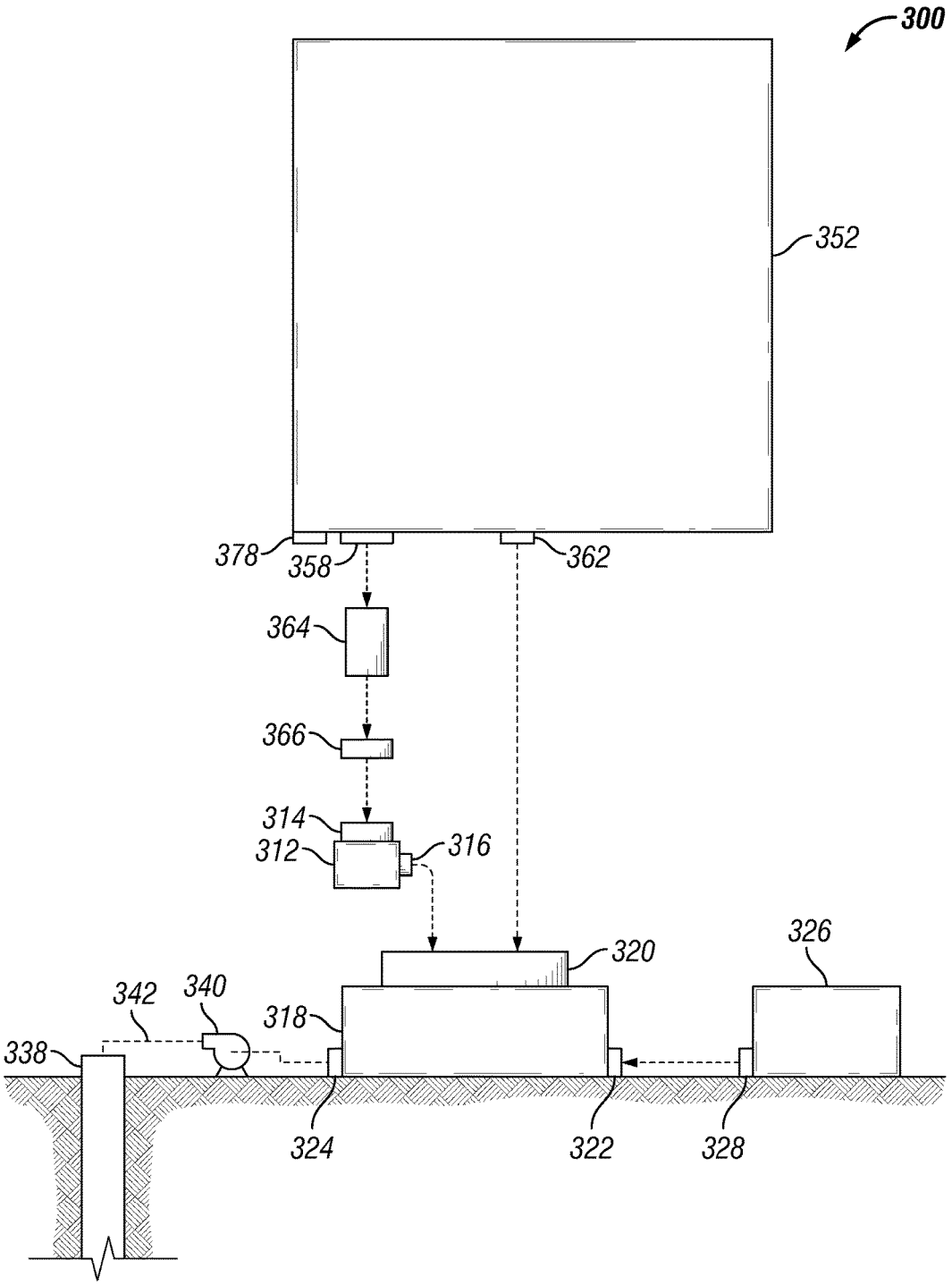
FIG. 14 illustrates some embodiments in accordance with the disclosure.
Figure 15:
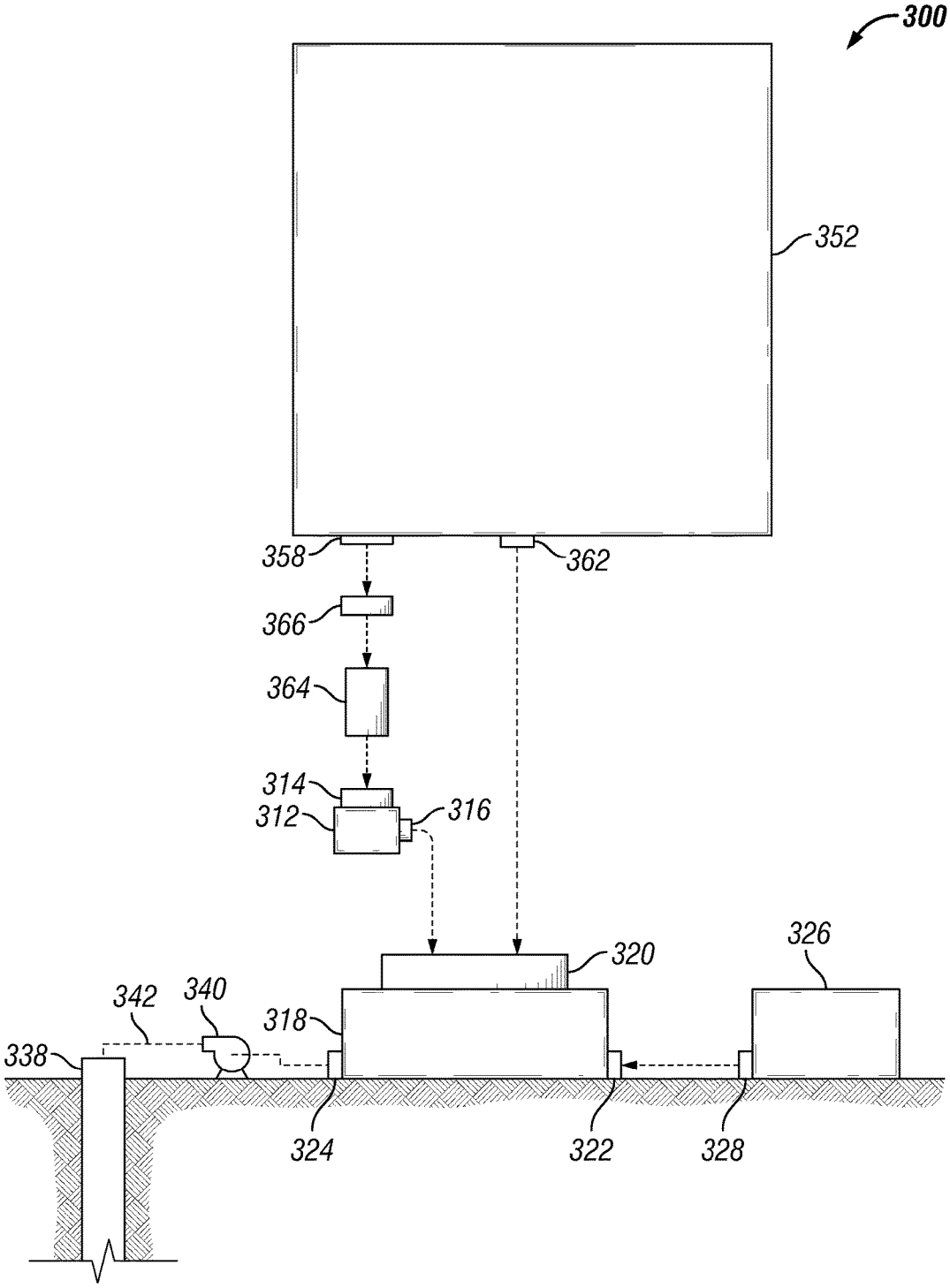
FIG. 15 illustrates some embodiments in accordance with the disclosure.

In accordance with some embodiments, and with reference to FIGS. 13-14, a chute 364 can be positioned between the silo packet outlet 358 and the packet shredder inlet 314 to convey the packets from the silo packet storage area 356 to the packet shredder 312. In accordance with some embodiments, as shown in FIG. 14, a metering device 366 can be positioned between the chute 364 and the packet shredder inlet 314 to meter the packets prior to conveying the packets to the packet shredder 312. In accordance with some embodiments, as shown in FIG. 15, the metering device 366 can be positioned between the silo packet outlet 358 and the chute 364 to meter the packets prior to conveying the packets to the chute 364. The metering device can be selected from the group consisting of a metering auger, an optical counter device, or a rotary valve that selectively allows a given number of pouches per revolution, or combinations thereof.

Figure 16:
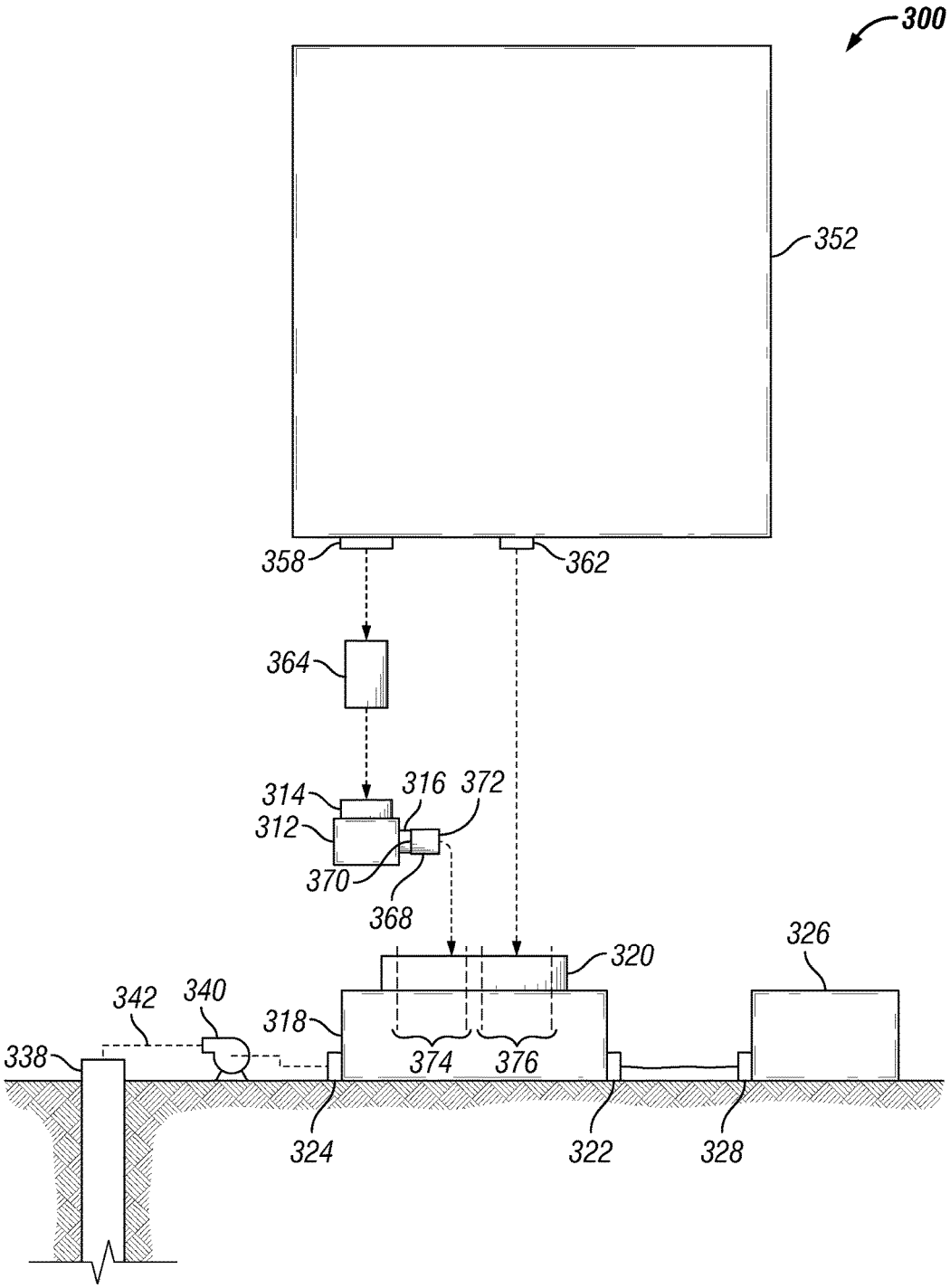
FIG. 16 illustrates some embodiments in accordance with the disclosure.

In accordance with some embodiments, as shown in FIG. 16, system 300 can further comprise an auger 368 having an auger inlet 370 and an auger outlet 372; and wherein the shredder outlet 316 is connected in fluid flow communication with the auger inlet 370 and the auger outlet 372 is positioned in fluid flow communication with the first mixer inlet 320. In accordance with some embodiments, as shown in FIG. 16, the auger outlet 372 can be positioned above a first area 374 of first mixer inlet 320; and wherein the silo proppant outlet 362 can be positioned above a second area 376 of first mixer inlet 320.

In accordance with some embodiments, the additive 1702 can be a solid material selected from the group consisting of fluid loss additives, breakers, and fiber. In accordance with some embodiments, the liners 1703 of each of the packets 1701 can be water soluble, and the packets on average can contain less than about 1728 or less than 216, or less than 27 cubic inches of additive.

In accordance with some embodiments, and with reference to FIG. 1, a method for preparing a treatment fluid comprises providing the packets described above to first container packet storage area 104 of first container 102; passing the packets from the first container packet storage area 104 to the packet shredder 108 positioned below the first container 102; at least partially breaching the liners of the packets in packet shredder 108 to expose the additive, thereby forming exposed additive; passing the exposed additive to first mixer inlet 116 of mixer 114; passing an aqueous solution to the second mixer inlet 118 of the mixer 114; and mixing the exposed additive with the aqueous solution in the mixer 114 to form the treatment fluid. In accordance with some embodiments, with reference to FIG. 1, the treatment fluid can be charged from mixer outlet 120 to wellbore 126 penetrating the subterranean formation. The wellbore can be connected to the mixer outlet 120 by pump 128 and mixer outlet conduit 130, as shown in FIG. 1.

Figure 2:
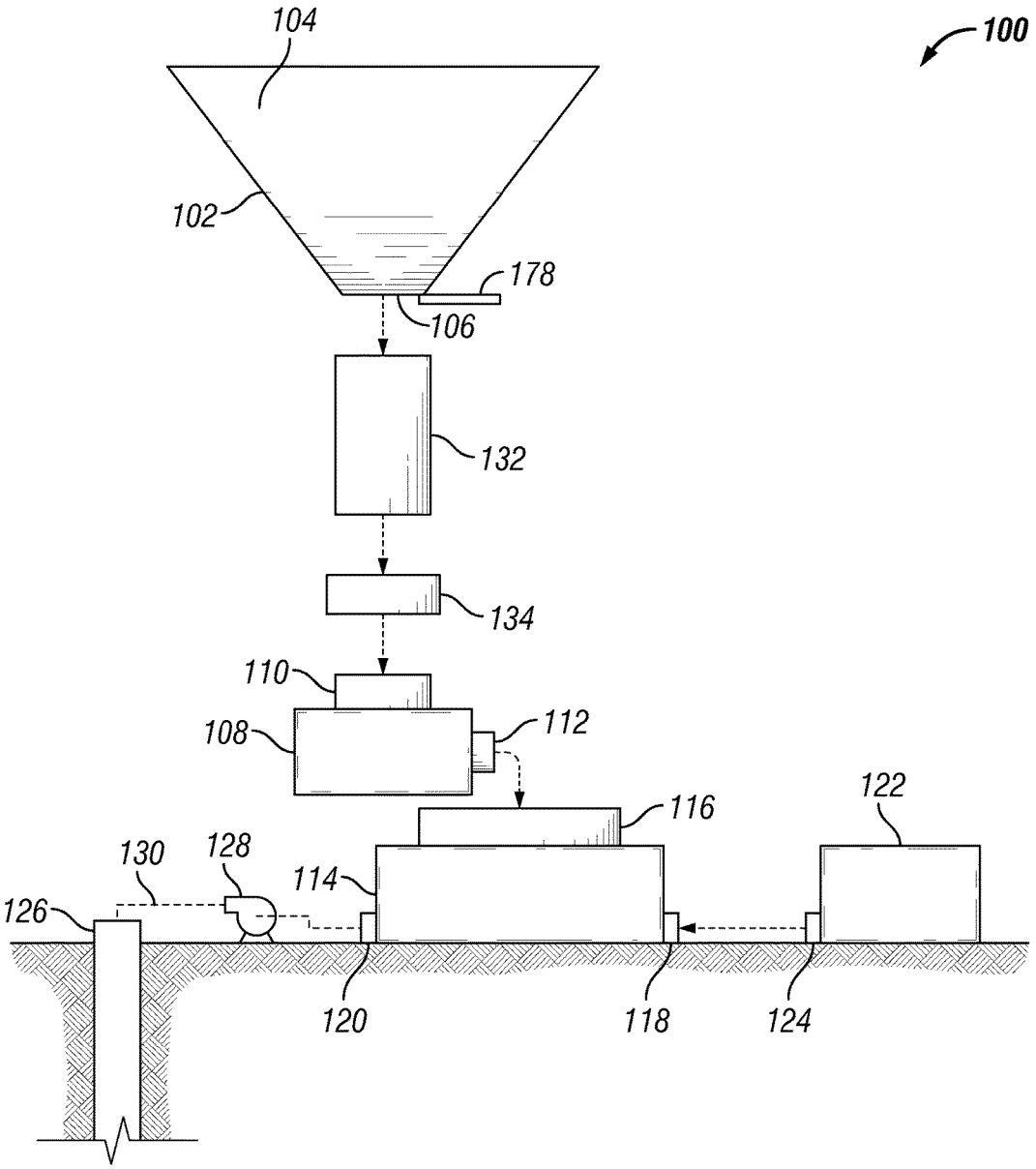
FIG. 2 illustrates some embodiments in accordance with the disclosure.
Figure 3:
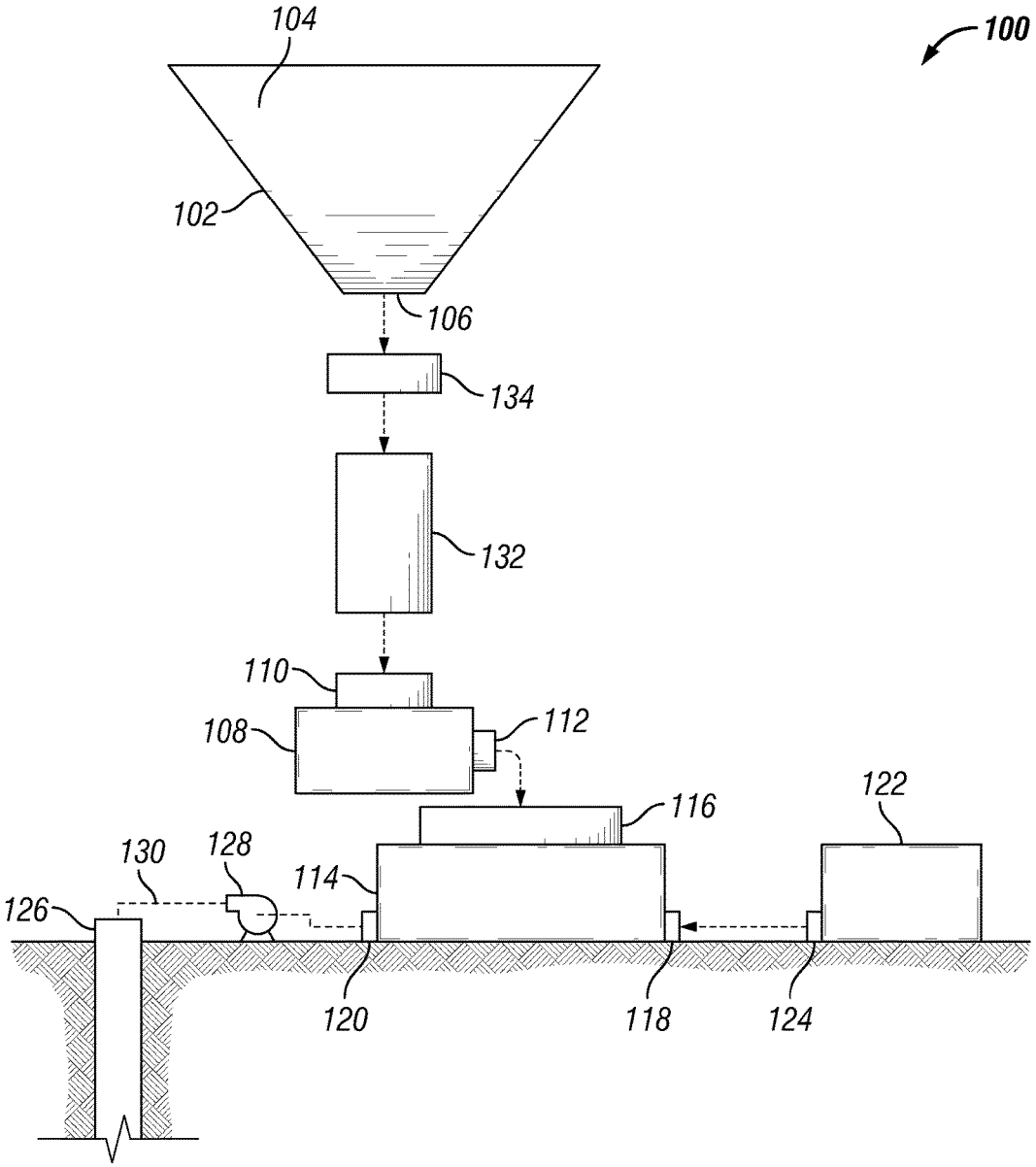
FIG. 3 illustrates some embodiments in accordance with the disclosure.

In accordance with some embodiments, with reference to FIG. 2, chute 132 is positioned between packet delivery opening 106 and packet shredder 108, and the packets can be charged from the first container packet storage area 104 to the chute 132 prior to passing to the packet shredder 108. In accordance with some embodiments, and with reference to FIG. 2, metering device 134 can be positioned between the chute 132 and the packet shredder 108; and the packets can be metered prior to conveyance to the packet shredder 108. Such metering allows greater control of the rate of additive addition to the mixture, and the meter data can be used in controlling the rate of introduction of packets to the packet shredder by, among other things, controlling the size of the packet delivery opening. The first container 102 can further comprise a gate valve 178 (shown in FIG. 2) in slidable arrangement with the packet delivery opening 106 to allow control of the size of the packet delivery opening 106. As shown in FIG. 3, the metering device 134 can be positioned between the packet delivery opening 106 and the chute 132, and the packets can be metered prior to conveyance to the chute 132, and then to packet shredder 108, for the reasons stated above.

Figure 4:
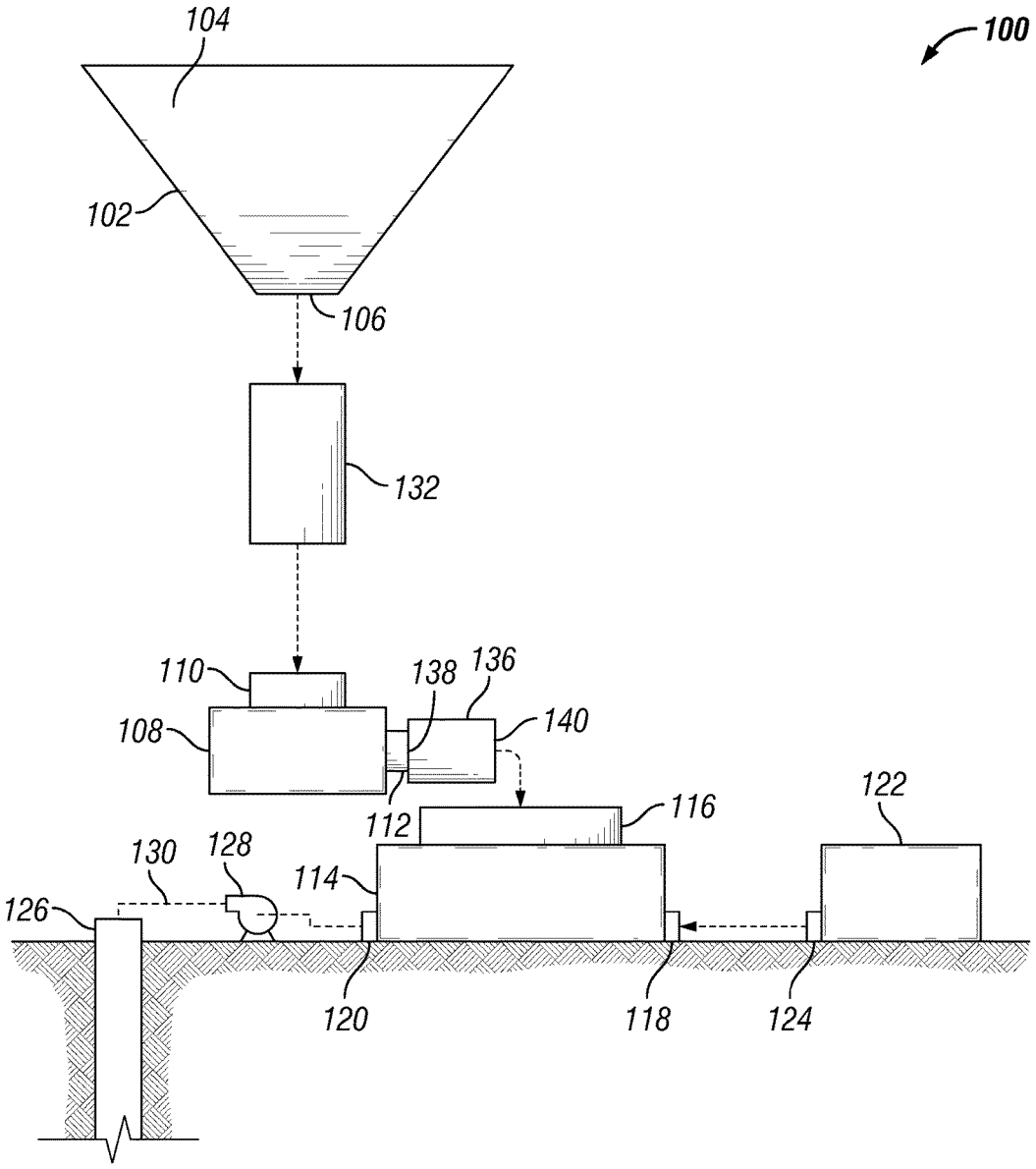
FIG. 4 illustrates some embodiments in accordance with the disclosure.

In accordance with some embodiments, as shown in FIG. 4, auger 136 can be positioned between the packet shredder 108 and the first mixer inlet 116, and the exposed additive from the packet shredder 108 can be passed to the auger inlet 138. The exposed additive can be passed from the auger outlet 140 to the first mixer inlet 116 of the mixer 114.

In accordance with some embodiments, and with reference to FIG. 5, a method for preparing a treatment fluid comprises providing the packets described above to first container packet storage area 204 of first container 202; passing the packets from the first container packet storage area 204 to the packet shredder 212 positioned below packet delivery opening 206 of first container 202; at least partially breaching the liners of the packets in packet shredder 212 to expose the additive, thereby forming exposed additive; passing the exposed additive to first mixer inlet 220 of mixer 218; passing an aqueous solution to the second mixer inlet 222 of the mixer 218; and mixing the exposed additive with the aqueous solution in the mixer 218 to form the treatment fluid. In accordance with some embodiments, and with reference to FIG. 5, proppant is charged to the first container proppant storage area 208 and the proppant can be passed to the first mixer inlet 220 of the mixer 218 to become a part of the treatment fluid. In accordance with some embodiments, the proppant can be first combined with the exposed additive prior to passing to the mixer (not shown). In accordance with some embodiments, with reference to FIG. 5, the treatment fluid can be charged from mixer outlet 224 to wellbore 238 penetrating the subterranean formation. The wellbore can be connected to the mixer outlet 224 by pump 240 and mixer outlet conduit 242, as shown in FIG. 5. The system useful for carrying out the method(s) as described herein can be any of the above described embodiments or equivalents thereof.

In accordance with some embodiments, as described above with reference to FIGS. 7-9, at least one silo 252 can be positioned above the first container 202. The proppant can be passed from the silo proppant storage area 260 to the first container proppant storage area 208, and the packets can be passed from the silo packet storage area 256 to the first container packet storage area 204.

In accordance with some embodiments, with reference to FIG. 10, chute 264 is positioned between packet delivery opening 206 and packet shredder 212, and the packets can be charged from the first container packet storage area 204 to the chute 264 prior to passing to the packet shredder 212. In accordance with some embodiments, and with reference to FIG. 10, metering device 266 can be positioned between the chute 264 and the packet shredder 212; and the packets can be metered prior to conveyance to the packet shredder 212. Such metering allows greater control of the rate of additive addition to the mixture, and the meter data can be used in controlling the rate of introduction of packets to the packet shredder by, among other things, controlling the size of the packet delivery opening. The first container 202 can further comprise a gate valve 278 (shown in FIG. 10) in slidable arrangement with the packet delivery opening 206 to allow control of the size of the packet delivery opening 206. As shown in FIG. 11, the metering device 266 can be positioned between the packet delivery opening 206 and the chute 264, and the packets can be metered prior to conveyance to the chute 264, and then to packet shredder 212, for the reasons stated above.

In accordance with some embodiments, as shown in FIG. 12, auger 268 can be positioned between the packet shredder 212 and the first mixer inlet 220, and the exposed additive from the packet shredder 212 can be passed to the auger inlet 270. The exposed additive can be passed from the auger outlet 272 to the first mixer inlet 220 of the mixer 218. As shown in FIG. 12, the auger outlet 272 can be positioned above first area 274 of the first mixer inlet 220 and the exposed additive can be passed to the first area 274 of the first mixer inlet 220, and the proppant can be passed from proppant delivery opening 210 to second area 276 of the first mixer inlet 220.

In accordance with some embodiments, and with reference to FIGS. 13 and 13A, a method for preparing a treatment fluid comprises providing the packets described above to silo packet storage area 356 of silo 352 (the first container); passing the packets from the silo packet storage area 356 to the packet shredder 312 positioned below silo packet outlet 358 of silo 352; at least partially breaching the liners of the packets in packet shredder 312 to expose the additive, thereby forming exposed additive; passing the exposed additive to first mixer inlet 320 of mixer 318; passing an aqueous solution to the second mixer inlet 322 of the mixer 318; and mixing the exposed additive with the aqueous solution in the mixer 318 to form the treatment fluid. In accordance with some embodiments, and with reference to FIGS. 13 and 13A, proppant is charged to the silo proppant storage area 360 and the proppant can be passed to the first mixer inlet 320 of the mixer 318 to become a part of the treatment fluid. In accordance with some embodiments, the proppant can be first combined with the exposed additive prior to passing to the mixer (not shown). In accordance with some embodiments, with reference to FIGS. 13 and 13A, the treatment fluid can be charged from mixer outlet 324 to wellbore 338 penetrating the subterranean formation. The wellbore can be connected to the mixer outlet 324 by pump 340 and mixer outlet conduit 342, as shown in FIG. 13. The system useful for carrying out the method(s) as described herein can be any of the above described embodiments or equivalents thereof.

In accordance with some embodiments, with reference to FIG. 14, chute 364 is positioned between silo packet outlet 358 and packet shredder 312, and the packets can be charged from the silo packet storage area 356 to the chute 364 prior to passing to the packet shredder 312. In accordance with some embodiments, and with reference to FIG. 14, metering device 366 can be positioned between the chute 364 and the packet shredder 312; and the packets can be metered prior to conveyance to the packet shredder 312. Such metering allows greater control of the rate of additive addition to the mixture, and the meter data can be used in controlling the rate of introduction of packets to the packet shredder by, among other things, controlling the size of the silo packet outlet 358. The silo 352 can further comprise a gate valve 378 (shown in FIG. 14) in slidable arrangement with the silo packet outlet 358 to allow control of the size of the silo packet outlet 358. As shown in FIG. 15, the metering device 366 can be positioned between the silo packet outlet 358 and the chute 364, and the packets can be metered prior to conveyance to the chute 364, and then to packet shredder 312, for the reasons stated above.

In accordance with some embodiments, as shown in FIG. 16, auger 368 can be positioned between the packet shredder 312 and the first mixer inlet 320, and the exposed additive from the packet shredder 312 can be passed to the auger inlet 370. The exposed additive can be passed from the auger outlet 372 to the first mixer inlet 320 of the mixer 318. As shown in FIG. 16, the auger outlet 372 can be positioned above first area 374 of the first mixer inlet 320 and the exposed additive can be passed to the first area 374 of the first mixer inlet 320, and the proppant can be passed from silo proppant outlet 362 to second area 376 of the first mixer inlet 320.

In accordance with some embodiments, the aqueous solution described above can comprise components selected from the group consisting of gelling agents, friction reducers, surfactants, biocides, cross-linkers, acids, fluid-loss additives, breakers, fibers in aqueous suspension, and combinations thereof.

Figure 17A:
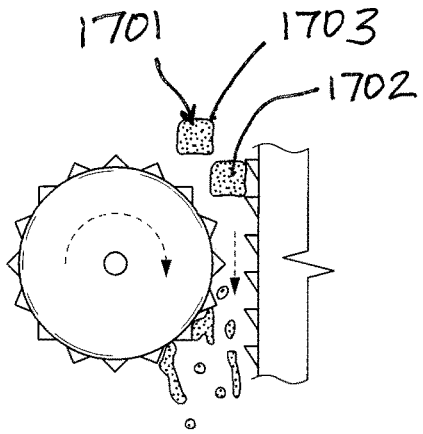
FIGS. 17A-17D depict embodiments of a packet shredder in accordance with the disclosure.
Figure 17B:
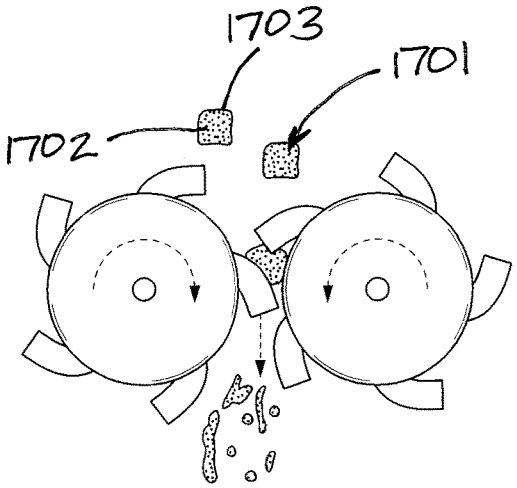
Figure 17C:
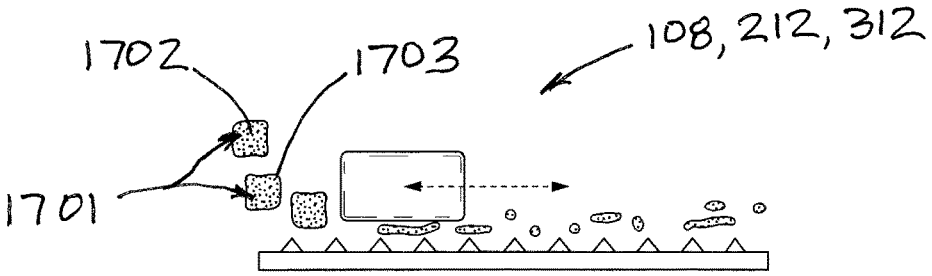
Figure 17D:
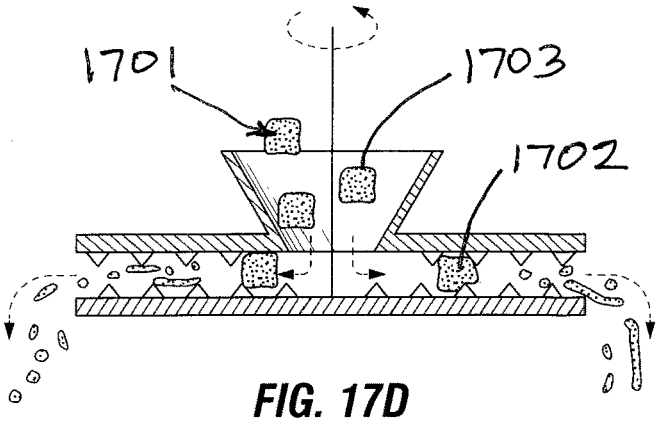

In accordance with some embodiments, the packet shredder depicted as reference number 108 in FIGS. 1-4, and depicted (see FIG. 17C) as reference number 212 in FIGS. 5, 7, and 10-12, and depicted as reference number 312 in FIGS. 13-16 can be any shredder or other device capable of breaching the respective liners 1703 of the packets 1701, thereby exposing the additive 1702, as seen in FIGS. 17A-17D. The shredder or device can comprise a sharp blade, such as a stationary knife, a handheld knife, cutting wheels, or augers. The packet shredder can be selected from the group consisting of a cheese-grater type shredder as shown in FIG. 17A, a shredder employing multiple fingers on two counter rotating shafts as shown in FIG. 17B, a sliding block shredder as shown in FIG. 17C, a rotary disc shredder as shown in FIG. 17D, or any combination thereof.

In accordance with some embodiments, the mixer depicted as reference number 114 in FIGS. 1-4, and depicted as reference number 218 in FIGS. 5, 7 and 10-12, and depicted as reference number 318 in FIGS. 13-16 can be any mixer capable of mixing the additive and/or proppant with the aqueous solution for preparation of a treatment fluid. The mixer can be a pod mixer including an upwardly facing slinger disc coupled to a downwardly facing impeller. In operation, the mixer can create an open eye within the slurry circulating above the slinger disc. The open eye can have a diameter from about 0.25 to about 8 feet, or from about 0.5 to about 3 feet, or from about 1 foot to about 2 feet. With reference to FIGS. 12 and 16, the first area (274 in FIGS. 12 and 374 in FIG. 16) is positioned above one side of the slurry ring forming the eye and the second area (276 in FIGS. 12 and 376 in FIG. 16) is positioned above the other side of the slurry ring forming the eye. In accordance with an embodiment, the mixer can also be a mix tank that can be rectangular or square or round, can be up to the size of a road legal trailer (8 feet wide), and the top can be open for directly dumping the additives/packets into the fluid.

Figure 18:
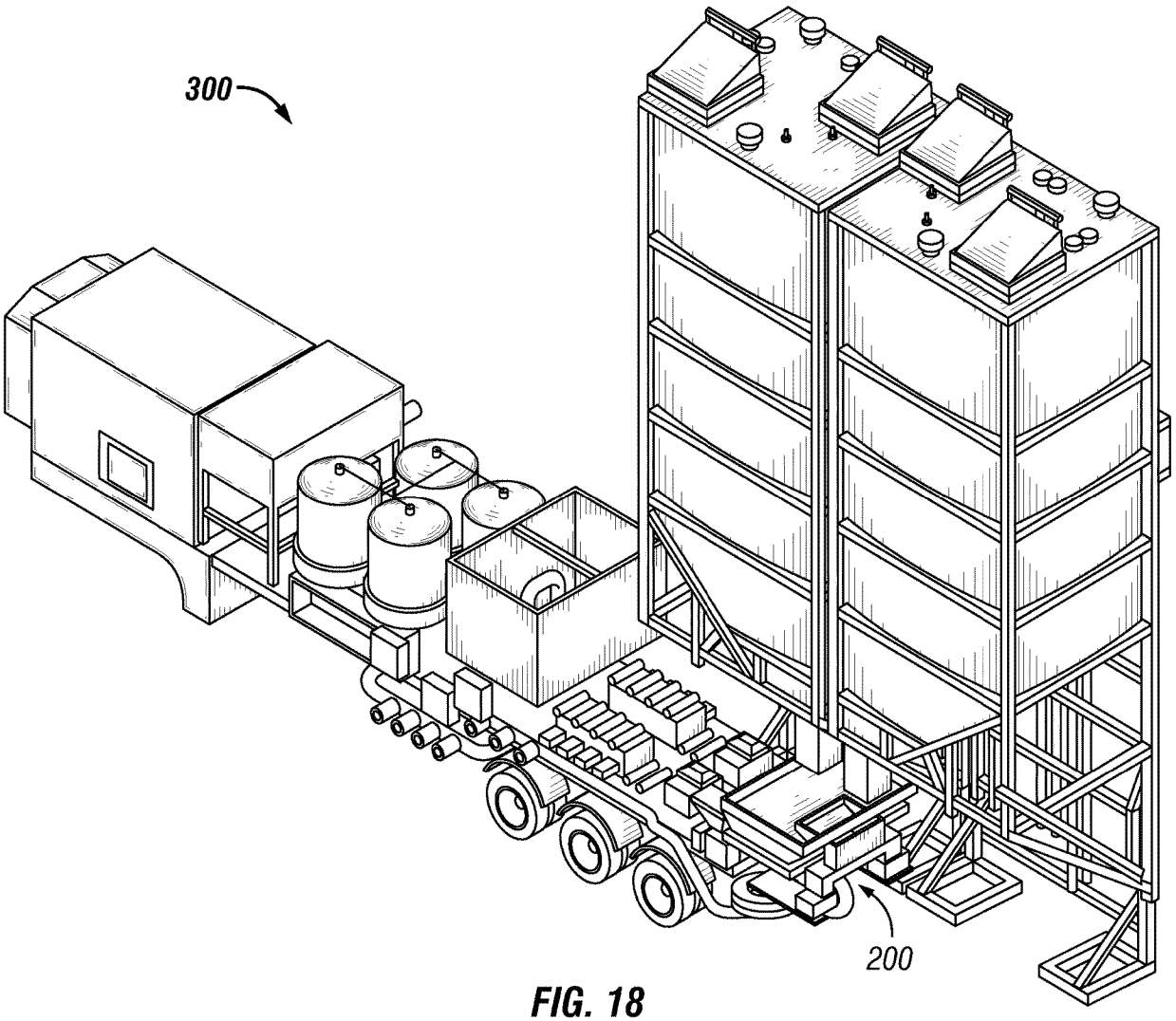
FIG. 18 is a perspective view illustrating some embodiments in accordance with the disclosure.
Figure 19:
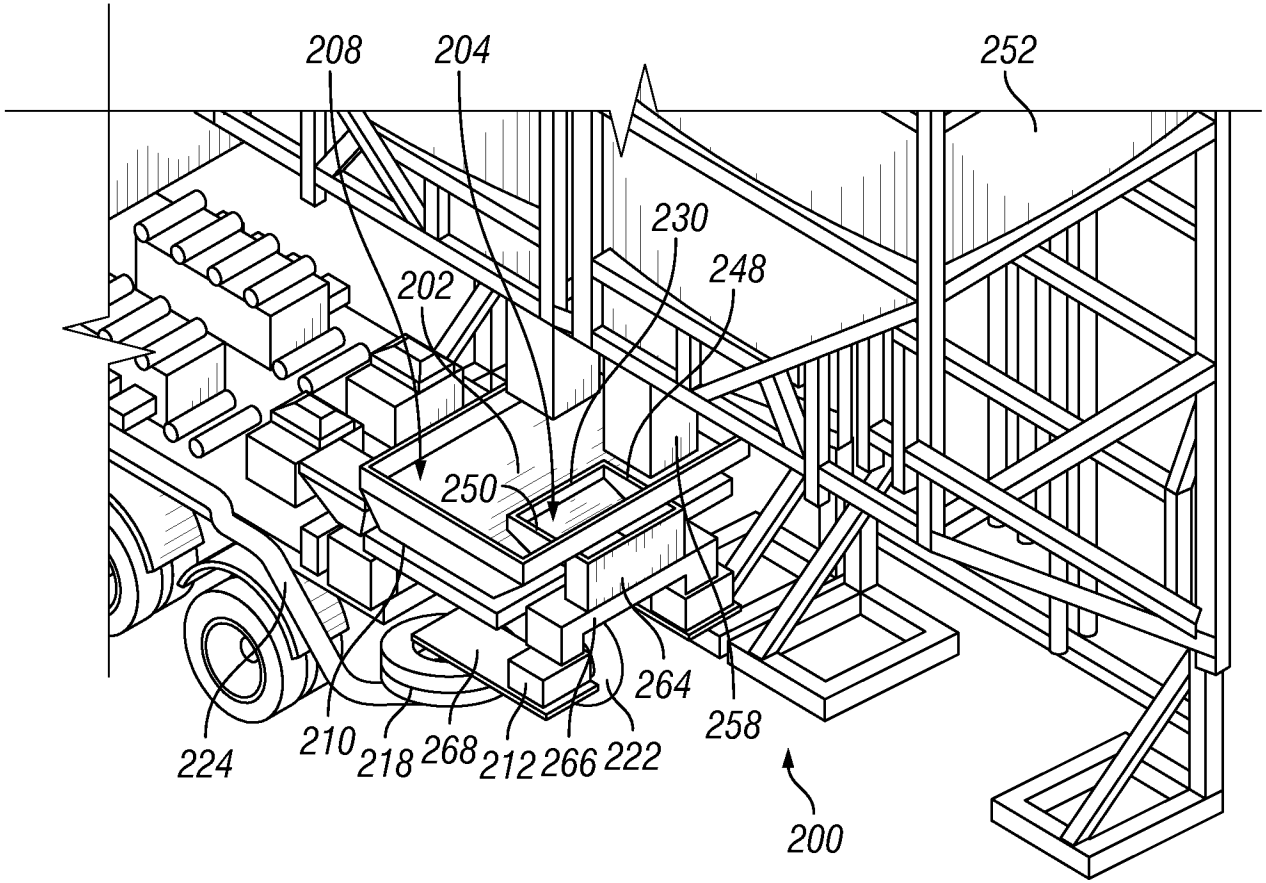
FIG. 19 is an enlarged perspective view of system 200 in FIG. 18 illustrating some embodiments in accordance with the disclosure.
Figure 20:
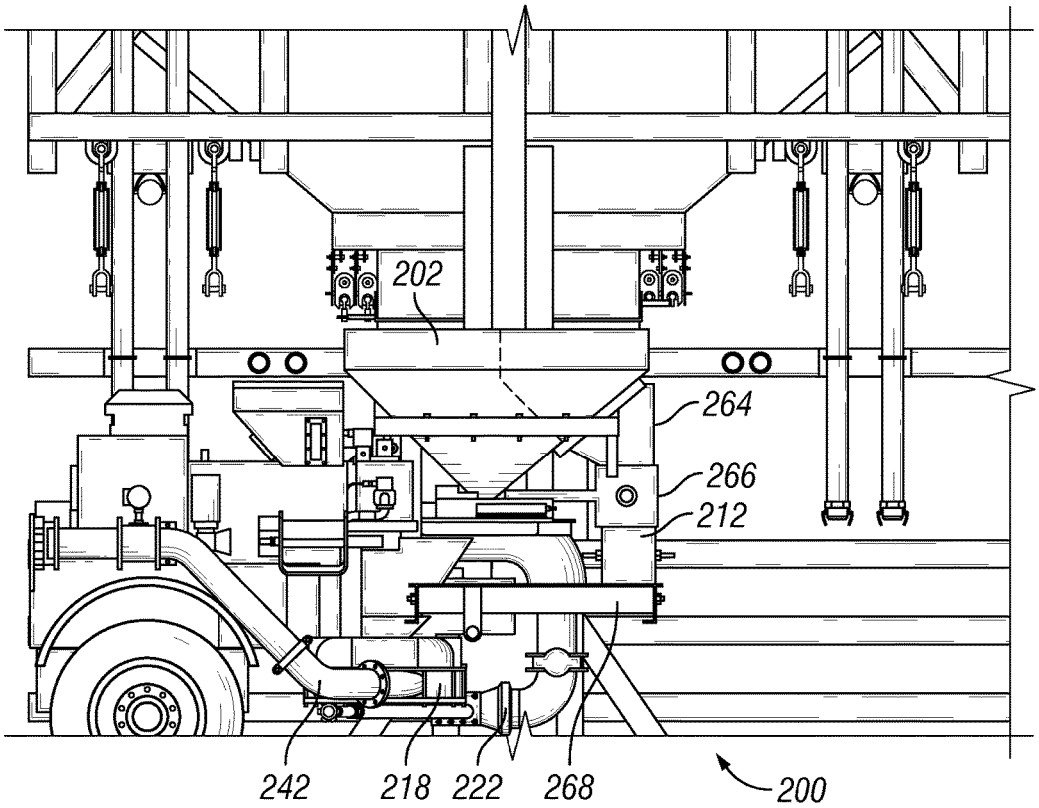
FIG. 20 is an enlarged side view of system 200 in FIG. 18 illustrating some embodiments in accordance with the disclosure.

In accordance with some embodiments, FIG. 18 shows a perspective view of the system 200 as positioned on a process trailer at a wellsite. FIG. 19 shows an enlarged perspective view of system 200 from that shown in FIG. 18, and FIG. 20 is an enlarged side view of system 200 from that shown in FIG. 18. The reference numbers in FIGS. 19 and 20 are the same as those used in describing system 200 with reference to FIGS. 5-12 as described herein.

As used herein, the term "fluid flow communication" shall include connection of devices by pipes or other conduits, and shall also include fluid flow communication by gravity. For example, such as when a component passes from a first device to a second device positioned below the first device, even if the inlet of the second device is not physically connected to the outlet of the first device by a pipe or other conduit.

The foregoing description of the embodiments has been provided for purposes of illustration and description. Example embodiments are provided so that this disclosure will be thorough, and will fully convey the scope to those who are skilled in the art. Numerous specific details are set forth such as examples of specific components, devices, and methods, to provide a thorough understanding of embodiments of the disclosure, but are not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may be present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although various embodiments have been described with respect to enabling disclosures, it is to be understood the invention is not limited to the disclosed embodiments. Variations and modifications that would occur to one of skill in the art upon reading the specification are also within the scope of the invention, which is defined in the appended claims.

What is claimed is:

1. A method for preparing a treatment fluid comprising:

disposing a plurality of individual packets in a first container packet storage area of a first container, each of the plurality of packets comprising an additive encased within a liner;

passing the plurality of individual packets from the first container packet storage area to a packet shredder positioned below the first container;

metering the individual packets while passing the packets from the first container packet storage area to the packet shredder;

utilizing the packet shredder to at least partially breach the liners of the packets to expose the additive, thereby forming exposed additive;

passing the exposed additive through a first mixer inlet of a mixer;

storing proppant separate from the additive;

delivering the proppant into the mixer;

passing an aqueous solution through a second mixer inlet of the mixer and thus exposing the additive and the proppant to the aqueous solution; and mixing the exposed additive, the proppant, and the aqueous solution in the mixer to form the treatment fluid.

2. The method of claim 1 wherein the treatment fluid is charged to a wellbore penetrating a subterranean formation.

3. The method of claim 1 wherein the first container further comprises a first container proppant storage area;

providing proppant to the first container proppant storage area; and passing the proppant to the first mixer inlet of the mixer to become a part of the treatment fluid.

4. The method of claim 3 wherein the first container is a hopper and wherein the first container packet storage area is defined by a diverter sealably attached to an inner wall of the first container.

5. The method of claim 4 wherein the diverter comprises: a) a diverting plate comprising a lower end attached to the inner wall of the first container, an upper end, a first side edge and a second side edge, b) a first sealing member attached to the first side edge and the inner wall, and c) a second sealing member attached to the second side edge and the inner wall.

6. The method of claim 5 wherein the lower end of the diverting plate is hinged to the inner wall of the first container and the configurations of the first sealing member and the second sealing member are each adjustable to allow changes in the position of the diverting plate, allowing adjustment of the sizes of the first container packet storage area and the first container proppant storage area.

7. The method of claim 6 wherein the upper end of the diverting plate comprises a hinged section.

8. The method of claim 4 further comprising:

utilizing a silo positioned above the first container and comprising a partition dividing the silo into a silo packet storage area comprising the packets and a silo proppant storage area comprising the proppant;

passing the proppant from the silo proppant storage area to the first container proppant storage area; and passing the packets from the silo packet storage area to the first container packet storage area.

9. The method of claim 3 wherein the exposed additive is passed to a first area of the first mixer inlet; and wherein the proppant is passed to a second area of the first mixer inlet.

10. The method of claim 1 wherein the liners of the packets are water soluble and wherein the packets on average contain less than about 1728 cubic inches of additive per packet.

11. The method of claim 1 wherein metering comprises metering the individual packets with a metering device.

12. The method of claim 1, wherein metering controls the rate of introduction of packets to the packet shredder.

* * * * *